US009773480B2

(12) United States Patent
Rapp

(10) Patent No.: US 9,773,480 B2
(45) Date of Patent: Sep. 26, 2017

(54) ELECTRONIC MUSIC CONTROLLER USING INERTIAL NAVIGATION-2

(71) Applicant: John W. Rapp, Manassas, VA (US)

(72) Inventor: John W. Rapp, Manassas, VA (US)

( * ) Notice: Subject to any disclaimer, the term of this patent is extended or adjusted under 35 U.S.C. 154(b) by 3 days.

(21) Appl. No.: 14/680,591

(22) Filed: Apr. 7, 2015

(65) Prior Publication Data

US 2015/0287395 A1 Oct. 8, 2015

Related U.S. Application Data

(63) Continuation of application No. 13/716,083, filed on Dec. 14, 2012, now Pat. No. 9,035,160.

(60) Provisional application No. 61/570,621, filed on Dec. 14, 2011.

(51) Int. Cl.

| | |
|---|---|
| ***G10D 13/02*** | (2006.01) |
| ***G10D 13/00*** | (2006.01) |
| ***G10H 3/12*** | (2006.01) |
| ***G10H 7/00*** | (2006.01) |
| ***G10H 1/00*** | (2006.01) |
| ***G10H 3/14*** | (2006.01) |

(52) U.S. Cl.

CPC ..... *G10D 13/003* (2013.01); *G10H 1/0066* (2013.01); *G10H 3/125* (2013.01); *G10H 3/146* (2013.01); *G10H 7/00* (2013.01); *G10H 2220/161* (2013.01); *G10H 2220/185* (2013.01); *G10H 2220/395* (2013.01); *G10H 2230/275* (2013.01)

(58) Field of Classification Search

CPC ..... G10H 3/146; G10H 1/0066; G10H 2220/525; G10H 1/0058; G10H 2220/395; G10H 2240/211; G10H 2230/275; G10H 2250/435; G10H 2240/056; G10H 2240/311; G10H 2220/201; G10H 2220/206; G10H 1/0083; G10H 2220/391; G10H 2230/251; G10H 2250/451

See application file for complete search history.

(56) References Cited

U.S. PATENT DOCUMENTS

| | | | |
|---|---|---|---|
| 7,030,305 | B1 | 4/2006 | Cupid |
| 7,060,887 | B2 | 6/2006 | Pangrle |
| 7,405,353 | B2 | 7/2008 | Kiyono et al. |
| 7,446,254 | B2 | 11/2008 | Lee |
| 8,003,873 | B2 | 8/2011 | Rasker |
| 8,063,296 | B2 | 11/2011 | Copeland et al. |
| 8,525,006 | B2 | 9/2013 | Yamanouchi |

(Continued)

OTHER PUBLICATIONS

"Non-Final Office Action", dated Sep. 11, 2014, issued in related U.S. Appl. No. 13/716,083.

(Continued)

*Primary Examiner* — Marlon Fletcher

(74) *Attorney, Agent, or Firm* — Kaplan Breyer Schwarz, LLP

(57) ABSTRACT

A percussion controller comprises an instrumented striker including devices for obtaining inertial measurements and a wireless transmitter, a sensor-enabled striking surface that receives an impact from the instrumented striker, and a data processing system that receives the inertial measurements and predicts at least one of the force or location of impact of the instrumented striker on the sensor-enabled striking surface before impact actually occurs.

39 Claims, 21 Drawing Sheets

(56) References Cited

U.S. PATENT DOCUMENTS 8,690,670 B2 4/2014 Kay et al.
8,801,521 B2 8/2014 Haga et al.
2001/0015123 A1 8/2001 Nishitani et al.
2002/0026866 A1 3/2002 Nishitani et al.
2002/0088335 A1 7/2002 Nishitani et al.
2005/0017454 A1 1/2005 Endo et al.
2006/0174756 A1 8/2006 Pangrle
2007/0107587 A1* 5/2007 Lee ..... G10H 1/46 84/723
2007/0265104 A1 11/2007 Haga et al.
2007/0270217 A1* 11/2007 Rabin ..... A63F 13/06 463/37
2009/0320672 A1* 12/2009 Rasker ..... G10H 1/0083 84/745
2010/0261513 A1* 10/2010 Izen ..... G10H 3/146 463/7
2010/0263518 A1 10/2010 Nishitani et al.
2011/0290097 A1* 12/2011 Takahashi ..... G10H 1/34 84/622
2011/0303076 A1* 12/2011 Harada ..... G10H 1/14 84/742
2012/0024128 A1* 2/2012 Takahashi ..... G10H 1/0008 84/600
2012/0090448 A1* 4/2012 Yamanouchi ..... G10H 3/146 84/723
2012/0103168 A1* 5/2012 Yamanouchi ..... G10H 1/0008 84/723
2012/0111179 A1* 5/2012 Yamanouchi ..... G10H 1/42 84/723
2012/0152087 A1* 6/2012 Sakazaki ..... G10H 1/0008 84/600
2012/0216667 A1* 8/2012 Sakazaki ..... G10H 3/14 84/725
2013/0047823 A1* 2/2013 Tabata ..... G10H 1/0008 84/639
2013/0152768 A1* 6/2013 Rapp ..... G10H 3/125 84/634
2013/0228062 A1* 9/2013 Tabata ..... G10H 1/0008 84/602
2013/0239780 A1* 9/2013 Tabata ..... G10H 1/0008 84/602
2013/0239783 A1* 9/2013 Tabata ..... G10H 1/0008 84/609
2013/0239784 A1* 9/2013 Tabata ..... G10H 1/0008 84/609
2013/0239785 A1* 9/2013 Tabata ..... G10H 1/0008 84/609
2013/0255476 A1* 10/2013 Sakurai ..... G10H 5/00 84/723
2013/0262024 A1 10/2013 Sakurai et al.
2013/0340598 A1* 12/2013 Marquez ..... G10H 1/0558 84/730
2014/0260916 A1* 9/2014 Oppel ..... G10H 3/146 84/626

OTHER PUBLICATIONS

"Notice of Allowance", dated Jan. 21, 2015, issued in related U.S. Appl. No. 13/716,083.

* cited by examiner

ELECTRONIC MUSIC CONTROLLER USING INERTIAL NAVIGATION-2

STATEMENT OF RELATED CASES

This case is a continuation of co-pending U.S. patent application Ser. No. 13/716,083, filed Dec. 14, 2012, which claims priority of U.S. Provisional Patent Application Ser. No. 61/570,621, filed Dec. 14, 2011, each of which is incorporated by reference herein.

FIELD OF THE INVENTION

The present invention relates to percussion controllers.

BACKGROUND OF THE INVENTION

A musical instrument that produces sound as a result of one object striking another is known as a "percussion" instrument. The striking object can be a person's hands/fingers, such as when one plays bongos or a piano. Or the striking object can be something held by a musician, such as a drum stick, mallet, or beater, for striking a drum or triangle, for example.

A percussion "controller" is an electronic device that senses impacts and pressures associated with performing musical rhythms using virtual music software and sound synthesis in conjunction with either computers or electronic musical instruments, such as synthesizers. The performer typically uses the controller to accompany other performers who are using other instruments, for example, trumpets, pianos, guitars, etc. In other words, an electronic drum set has both a percussion controller and a drum synthesizer. Triggered by the performer, the percussion controller sends messages, which contain information about pitch, intensity, volume level, tempo, etc., to devices that actually create the percussive sounds. Percussion controllers are available in a variety of different forms and vary widely in capabilities.

Basic percussion controllers typically include a set of resilient (e.g., rubber or rubber-like, etc.) pads that can be played with either drum sticks or the musician's hands and fingers. In some cases, these controllers are integrated with a synthesizer. In such cases, the synthesizer generates rhythm "signals," which produce rhythm sounds after transmission to and playback over an audio system. The percussion controllers and synthesizer are sometimes federated (i.e., separate devices), which enables buyers to select a best controller and a best synthesizer from different manufacturers.

Percussion controllers may also be capable of receiving the triggering rhythm patterns on conventional percussion instruments, such as acoustic drum sets, cymbals, and hand drums. To do so, the acoustic instrument is typically equipped with electronic triggers.

Drummers can also choose to retrofit a traditional acoustic drum kit with a controller and drum/cymbal triggers. This enables the drummer to add his own acoustic accompaniment to the sounds generated by the controller, thereby creating rhythmic effects that would otherwise be impossible using traditional percussion instruments alone. Many drummers today are combining their acoustic drums with additional percussion controllers. This enables them to achieve the dynamics and responsive feeling attainable only from actual drums and cymbals, while also realizing the benefits of compactness and electronic convenience of triggered percussion sounds, like cow bells and ago-go bells, wood blocks, conga drums, gongs, tympani, and the like.

Although quite useful for expanding the sound-generating capabilities of a musician, currently-available percussion controllers are not without their limitations and drawbacks.

First, conventional percussion controllers sense the dynamics of impacts in a predefined physical impact zone that is instrumented with pressure- or force-detecting sensors. The controllers then process the sensor signals. This technique of electronic sensing captures only a limited part of the dynamic range of the percussions.

Also, to the extent that the percussion requires more sensors, such additional sensors can interfere with one another. Increased processing is required to remove this "cross-talk," which further reduces the dynamic range available. In fact, the signal processing exhibits combinatorial growth for each additional sensor. This approach to sensing thus limits the ability of the controller to accurately capture a percussionist's performance, limits the number of impact zones available to the percussionist, and drives up the cost of the percussion controller itself.

The performer notices these limitations as occasional false notes and a general lack of realism responding to the thrown forces. A design that reduces the occurrence of false notes results in a reduction in dynamic responsiveness. Furthermore, the performer also notices a lack of tonal dynamic response to strike placement as compared with the way that acoustic percussion instruments naturally respond. Consider that a snare drum exhibits a continuum of tones depending on where the strike is placed. Typical percussion controllers offer one or two positional sound variations. Although rather impractical, it would take hundreds of sensors across a fourteen-inch-diameter surface to recreate the tonal location sensitivity of a single snare drum batter. The same locational sensitivity occurs for a ride cymbal (about 20 inches in diameter), for a hi-hat (about 14 inches in diameter), and perhaps to a lesser extent for crash cymbals and tom-toms. As a consequence, a trap-set percussion controller with realistic locational sensitivity would require many thousands of sensors.

Second, percussionists use many different techniques; for example finger throwing, finger muting, stick throwing, mallet throwing, etc. Conventional percussion controllers are custom designed for one or another of these techniques.

Further consideration of stick throwing reveals different striking techniques, such as by using the stick's tip, shank, or butt. Striking an acoustic percussion instrument using these different techniques results in different sounds. Conventional percussion controllers are unable to detect and respond differently to these different percussive techniques.

Also, percussion instruments exhibit a wide variation of physical arrangements (e.g., a trap set, a snare drum, a triangle, maracas, a tympani, a xylophone, a piano, etc.). So, notwithstanding the flexibility potentially provided by an electronic implementation of an instrument, an electronic multi-percussionist will nevertheless be forced to purchase many different custom-designed percussion controllers (e.g., an electronic xylophone, an electronic trap-set, and an electronic hand-drum, etc.).

Third, a percussionist' ability to place a strike improves with training and practice. This improved ability enables a percussionist to direct a strike to increasingly specific (i.e., smaller) regions of an instrument with increasing accuracy. Unfortunately, existing custom-designed percussion controllers do not possess an ability to decrease the spacing between striking zones, which would enable the creation of additional striking zones. As a consequence, with improvement, the percussionist either compromises their abilities with the more basic controller or buys, at significant expense, a new controller more suitable to their improved abilities. A far more desirable alternative would be for the percussion controller to have the ability to adapt to the improving percussionist.

Discussion of Conventional Percussion Controllers

Roland Corporation HandSonic 15.

This device is an electronic hand percussion multi-pad that, according to the manufacturer, permits a hand percussionist to play up to 600 acoustic and electronic percussion sounds, and up to 15 such sounds simultaneously. FIG. 1 depicts the pad of the HandSonic 15. As depicted, the pad, which is 10 inches in diameter, includes fifteen discrete regions or physical-impact zones, separated by indentations. The impact zones are arranged in a fixed configuration suited for hand percussion and finger percussion techniques, such as for Tabla or Conga. A pressure sensor, not depicted, is disposed under each physical-impact zone.

The mat absorbs some of the impact from the hand/fingers and creates a rebound or bounce to provide a more natural feel to the performer. Below the mat, and under each physical-impact zone, is an individual pressure sensor. A structural base is disposed beneath the sensors. There may be stiff shock-isolating devices integrated between the base and the sensor. A small processor samples all the sensors, and processes each sensor signal to adjust the sensor's sensitivity, remove noise, and most significantly remove the structure-borne cross-talk that occurs when the physical impact on one sensor is acoustically transferred through the sensor to the base and subsequently into adjacent sensors.

Alternate Mode Inc. trapKat.

The HandSonic 15 includes a sound synthesizer, which is integrated with the sensor-signal processor. Some controllers, such as the trapKat electronic percussion system, do not integrate the synthesizer or provide the synthesizer as an option. In such products, the processor must send control signals to the synthesizer. In either case, when either an impact or a pressure is detected in a zone, the measured strength of the impact/pressure is mapped to a musical event message (typically in accordance with the MIDI protocol) that is sent to the synthesizer.

The trapKat, which is depicted in FIG. 2, is customized by the manufacturer to facilitate the "trap-set" style of percussion. The trapKat includes 24 physical-impact zones including zones that the percussionist can program for playing cymbals, tom-toms, snares, hi-hat, and ride cymbal, special tones (e.g., cow bell, wood bloc, rim click, etc.)

The HandSonic 15 by Roland Corporation and the trapKat by Alternate Mode Inc. are similar in the sense that they both: (1) have a single structural base, (2) have sensors beneath an impact surface that is arranged into predefined zones, (3) process the array of sensor signals to remove noise and crosstalk, (4) detect zone impacts or pressures, and (5) map the zone impacts/pressures into events for synthesis.

The trapKat is designed to accommodate thrown (drum) sticks, which changes the arrangement and dimensions of the physical-impact zones. Although the trapKat can be configured to be played using hand or finger-throwing techniques, and it can map its zones to hand-percussion sounds, it is not as well suited to hand percussion as the HandSonic 15. Since neither the trapKat nor the HandSonic 15 is well suited to accommodate both stick and hand techniques, a multi-percussionist using these techniques would require both of these percussion controllers.

Roland Corporation's TD-9KX2-S V-Tour Series Drum Set.

A different approach to the trap-set percussion controller is illustrated by the TD-9KX2-S V-Tour Series drum set, depicted in FIG. 3. In this controller, the impact zones are federated and take the shape of real drum heads, rims and cymbals. The Ride cymbal and snare drum have two impact zones; the bell and mid-cymbal or the drum head and the rim. This collection of federated sensors and the sensor processor is the percussion controller. Often in this type of arrangement (as is the case for the TD-9KX2-S), the downstream drum synthesizer is integrated with the sensor processor as a single device.

This federated sensor device approach features the ability for the percussionist to physically arrange and customize the layout of the physical-impact zones along structural rails. But the railing still couples structure-borne cross-talk from one impacted sensor to other sensors.

All the prior-art approaches to percussion controllers suffer certain common problems. In particular, a percussionist playing an acoustic percussion instrument performs with a very wide dynamic range, sometimes exceeding 120 dB, ranging from the barely audible "triple pianissimo" to the explosively loud "triple forte." Sensors with such extreme dynamic range are very expensive. As a consequence, most percussion controllers use relatively less expensive sensors that disadvantageously cannot recreate such a broad dynamic range.

In summary, the drawbacks of existing percussion controllers include:

- Limited dynamics. This is a consequence of the limited range of sensor dynamics. In addition, induced electromagnetic noise also limits the lowest end of the dynamic range for detecting the lightest impacts.
- Crosstalk. Physical vibrational couplings exist between impact zones results in crosstalk between sensors. As a consequence, false notes get triggered. Crosstalk limits the ability to scale up the number of zones and limits the arrangement of the zones.
- Time lag. A processor must process the sensor signals and remove cross-talk, map the threshold crossing signal to an event, then format an event message for transmission to a synthesizer. Consequently, in response to an impact, an inevitable artificial time lag is incurred before actually generating a sound.
- Not reconfigurable. The size and number of impact zones is not reconfigurable. A professional percussionist can accurately place a strike inside a square 1% inches on each side while an amateur requires a much larger impact area. Fixed sensor-zone-dependent instrumented surfaces do not accommodate professional accuracy levels, do not accommodate the need for larger zones for novices, and do not adapt to the improving skill levels.
- Multiple custom surfaces required. A trap-set layout is fundamentally different from vibraphone layout. A percussive fret-board (mallet percussion arranged like a guitar neck with ranks of frets) is fundamentally different from a xylophone/piano layout. This requires that electronic multi-percussionists purchase and haul multiple percussion controllers for a performance.
- Instrumented surfaces cannot adequately sense a variety of different throwing techniques.
- Instrumented surfaces with large numbers of physical-impact zones (>30) are very expensive.
- Educational devices used for training percussion can only measure the timing of impacts; they do not provide training for the throwing techniques that percussionists need to master. Currently, a percussionist's throwing techniques can only be assessed in the presence of an instructor or expert.

A need remains for a percussion controller that addresses at least some of the aforementioned drawbacks of existing percussion controllers.

SUMMARY OF THE INVENTION

The present invention provides a percussion controller that is capable of exhibiting at least one and preferably more of the following characteristics/capabilities, among others:

- To alter the spacing between impact zones, such as to decrease the spacing as a performer's ability improves.
- To increase the number of impact zones and their arrangement as appropriate for the nature of the layout and/or the abilities of the performer.
- To provide an increased dynamic range relative to existing percussion controllers.
- To enable one surface to flexibly provide many different arrangements of impact zones.
- To improve the affordability of percussion controllers.

The present inventor recognized that a percussion controller having the desired capabilities can be realized by decoupling the sensing of impact intensity (i.e., force of impact) from the impacted surface. That is, to the extent a percussionist strikes a sensor-enabled surface, information related to the strike is not used to determine the force of impact of the strike. Rather, the information related to the strike is being used to determine the location of impact of the strike.

The present inventor recognized that even further advantages accrue by decoupling both the sensing of impact intensity and the sensing of impact location from the impacted surface. That is, the sensor-enabled surface is not used to determine either the force of the strike or the location of the strike.

To decouple the force and location measurements from the impacted surface, information pertaining to the kinetics of the striker (e.g., a drumstick, mallet, hand, etc.), as the striker is "thrown" by the percussionist, is obtained before the striker impacts the surface. That information is then processed using inertial navigation ("IN") techniques. This enables the force/pressure of the strike and location of the strike to be determined; that is, to be predicted, before the strike actually occurs.

It will be appreciated that if sensors are not being relied on for routine force and/or location determination, limitations arising from "cross-talk" become moot or of significantly reduced consequence. That results in improved dynamics, decreased cross-talk-induced triggering of false notes, no noise-related limitations on the size or configuration of "impact" zones, a reduction in processing-related time lags, and greatly increased utility since the surface can be freely reconfigured, among other benefits.

In the accordance with the illustrative embodiment, a percussion controller capable of achieving at least some of these objects comprises: (i) one or more instrumented strikers, (ii) a sensor-enabled striking surface, and (iii) a data processing system executing appropriate specialized software.

In the illustrative embodiment, the instrumented strikers include inertial sensing devices, which are capable of taking measurements related to the kinetics of the moving strikers. The sensor-enabled striking surface includes a mesh of contact (force/pressure) sensors that underlie a resilient striking surface.

In operation, a performer uses the instrumented striker(s) in the manner in which its non-instrumented analog is used. That is, the performer uses instrumented drum sticks in the same fashion as conventional drum sticks, etc. In the illustrative embodiment, readings from the inertial sensing device are transmitted from the instrumented strikers to the data processing system. In a significant departure from the prior art, the data processing system uses Inertial Navigation techniques to process the received data, predicting the force and, in some embodiments, the location of each impact before it actually occurs.

To relate the (predicted) location of a strike to a musical event (e.g., hitting a snare drum, etc.), the sensor-enabled surface is "virtually" segregated into a plurality of impact zones via the data processing system. Each such impact zone typically represents a different musical event. Prior to a first performance, the percussion controller is typically programmed to define and store a variety of impact zone arrangements. A desired arrangement is recalled by the performer before a performance. In some embodiments, the data processing system activates indicator lights that are associated with the sensor-enabled striking surface, thereby displaying the boundaries of the impact zones for the performer.

In the illustrative embodiment, with impact zones established and having predicted, via IN techniques, the force and location of the impact, the processor maps the predicted location into the appropriate predefined impact zone. This provides some information about a musical event (e.g., hitting a drum, etc.). The force prediction is used to provide additional information about the musical event; that is, how hard the drum is hit. In this fashion, the predicted force and location of the strike are mapped into musical events.

The percussion controller then generates musical event messages (e.g., via the MIDI protocol) for transmission to a synthesizer. The musical event messages control the synthesizer, causing it generate music signals that correspond to the received musical event messages. When amplified and delivered to a speaker, the musical signals result in desired sounds; that is, the musical performance.

Regardless of how information pertaining to the kinetics of the striker(s) is obtained (e.g., inertial measurements, EM interrogation, etc.) it must be transmitted to the data processing system without interfering with percussion performance techniques. To that end, in the illustrative embodiment, the data processing system and the measurement/sensing devices that obtain striker kinetics information are separated and communicate wirelessly with one another.

The sensor-enabled striking surface of the present percussion controller provides the following four functions, among any other others: (i) striker rebound; (ii) initialization; (iii) navigation error correction; and (iv) verification of IN predictions. These functions are discussed briefly below.

The presence of a resilient striking surface is very desirable. When a striker impacts a resilient striking surface, it rebounds, so as to more closely mimic an impact on an actual acoustic percussive instrument (e.g., drum heads, etc.).

IN needs to be initialized before it is used and requires ongoing error corrections. In accordance with the illustrative embodiment of the present invention, initialization and navigation error correction are accomplished by simply striking the sensor-enabled striking surface.

In some embodiments, the sensor-enabled striking surface is used to verify the predicted impact location. The force and/or location predictions will be issued a few milliseconds before actual impact on the striking surface. As a consequence, prediction accuracy will be very high, but there remains the possibility of extremely infrequent prediction errors. In such cases, at the time of impact, the data processing system might determine that there was a prediction error. Depending on the nature of the error, the data processing system may or may not take corrective action.

In some alternative embodiments, the striking surface is not sensor-enabled; it is simply a resilient striking pad. In such embodiments, an auxiliary instrumented pad is used to provide the initialization and updating functions. Since the percussionist would have to occasionally strike the auxiliary instrumented pad during a performance, such embodiments are less desirable than the illustrative embodiment in which the striking surface is instrumented. Furthermore, in such embodiments, the percussion controller will not be able to correct prediction errors.

It will be appreciated that by virtue of the techniques disclosed herein, musical event messages (e.g., a MIDI note-on, etc.) can be formatted and transmitted at predetermined intervals before an actual impact with the sensor-enabled striking surface. The performance is therefore enhanced since sensor-processing delay, event-mapping delay, event-message-formatting delay and queuing delay are eliminated.

In some embodiments, compensation is provided for the remaining "delays": including transmission delay, sound-generation-processing delay, and buffering delay. A specialized application running in the data processing system has parameters for predefined external delays that are stored and recalled by the performer to account for a wide variety of synthesis modules and transmission technologies that are available.

In some embodiments, the percussion controller includes "virtual" impact zones. These virtual impact zones are not on the sensor-enabled striking surface; rather, they are in "space" near the performer. The virtual impact zones effectively expand the area of the sensor-enabled striking surface. They can be used, for example, to "place" virtual instruments (e.g., splash and crash cymbals, etc.) in the locations they would reside in an actual drum set. The virtual impact zone boundaries are programmable and can be stored and recalled by the performer. The data processing system, applying information from the instrumented striker to IN as previously discussed, predicts the striker's impact with the virtual impact zones. The subsequent mapping of impact zones and impact force into musical events for the synthesizer is performed in known fashion.

In some further embodiments, striker motion is tracked (using IN techniques) and then that motion is correlated against predefined motion patterns. The subsequent mapping of matched motion patterns into musical events for the synthesizer is an adaptation of a conventional method. In other words, in such embodiments, predefined "non-throwing" motions of a striker are interpreted as musical commands.

In some embodiments, the percussion controller is capable of serving several percussionists by appropriately adapting the linked-layer protocol for the (wireless) striker communications, thereby eliminating any potential radio interference problems that might otherwise occur.

In some additional embodiments, throwing positions and forces used by the percussionist are monitored for the purpose of improving technique. More particularly, the processor accesses position-matching and force-matching algorithms (in addition to IN). This enables a student's throwing technique to be measured with high accuracy and then compared to a prerecorded reference performance, such as that of a teacher, expert, etc. This is expected to rapidly improve a student's throwing technique.

In yet some further embodiments, position-matching and force-matching algorithms are used in conjunction with IN to provide a background process that gathers statistics related to various good and bad throwing techniques exhibited by the percussionist during a musical performance. The information can aid the percussionist in correcting bad habits.

In some embodiments, the sensor-enabled striking surface with which the musician primarily interacts to "play" a virtual instrument, is supplemented by one or more "instrumented mats." The instrumented mat(s), which can be placed wherever convenient (e.g., on the floor at the musician's feet, etc.), can be used to control the operation of sensor-enabled striking surface. For example, the additional mat can be programmed so that:

striking it at a first location reconfigures the layout of a "trap-set" simulated by the sensor-enabled striking surface (i.e., alters the selection/position of the various drums, cymbals, etc., in the trap set); and striking that additional mat at a second location changes the instrument that the sensor-enable striking surface simulates; for example, from a trap set to a xylophone.

Alternatively, the one or more instrumented mat(s) can be operated as one or more separate instruments. For example, the sensor-enabled striking surface can be a trap-set and an additional instrumented mat can be a xylophone.

In some embodiments, the instrumented mats employ the same type of IN processing as the sensor-enabled striking surface, such that use of the mats require an instrumented "striker;" that is, for example, an instrumented slipper. In some other embodiments, IN processing is not used. Rather, the sensors in the mat are actuated by actual contact. This non-IN approach may be preferred in embodiments in which the mat is used simply to control the sensor-enabled striking surface since far fewer "zones" are likely to be required than when the mat is used as an actual instrument.

In summary, the illustrative embodiment of the present invention will incorporate one or more of the following features/characteristics/capabilities:

Determination of the force of a strike is decoupled from the striking surface.

Determination of the location of a strike is decoupled from the striking surface.

Programmable impact zone boundaries are saved and recalled.

Impact zones can be very small.

Impact zone boundaries are indicated with lighting.

The striker incorporates plural inertial sensors with minimal electronics, including, without limitation, appropriate circuitry, a capacitor, an inductive charger, and an antenna.

Instrumented strikers communicate wirelessly with the data processing system.

Instrumented strikers recharge in a recharging cradle.

Simultaneous use of two different types of strikers; for example, an instrumented glove and an instrumented stick/mallet/beater.

Using Inertial navigation to predict impact enables a reduction in sources of latency.

Navigation initialization and error correction can occur with every strike on the sensor-enabled striking surface.

Virtual impact zones, which are relative to and separate from the sensor-enabled striking surface, are defined.

Predefined non-throwing motions of a striker are interpreted as musical commands.

Instructional applications for learning throwing techniques using inertial navigation algorithms and position and force-matching algorithms. Striker accelerations and derived inertial navigation velocities and positions are recorded and interpreted for display to the student. Patterns of good technique can be interpreted for display and compared to the student performance.

Many performing percussionists can be served by the same system by extending the number of addresses in the data-link-layer protocol.

Using one or more supplemental mats that control or otherwise supplement the operation of the sensor-enabled striking surface.

The striker includes an energy-harvester for powering on-striker systems.

The advantages realized by the inventive approach include, without limitation:

The elimination of pre-established and fixed impact zones.

A reduction in latency.

Impact zones are virtually adjusted in the application software to suite the striking techniques of the performer.

A single surface adapts to a variety of percussive layouts (e.g., a trap kit, a xylophone, etc.).

A surface with hundreds or even thousands of "impact" zones becomes feasible (technically, economically, etc.).

A single percussion controller is used to switch between stick percussion, mallet percussion, hand percussion, and finger percussion.

DETAILED DESCRIPTION

Figure 1:
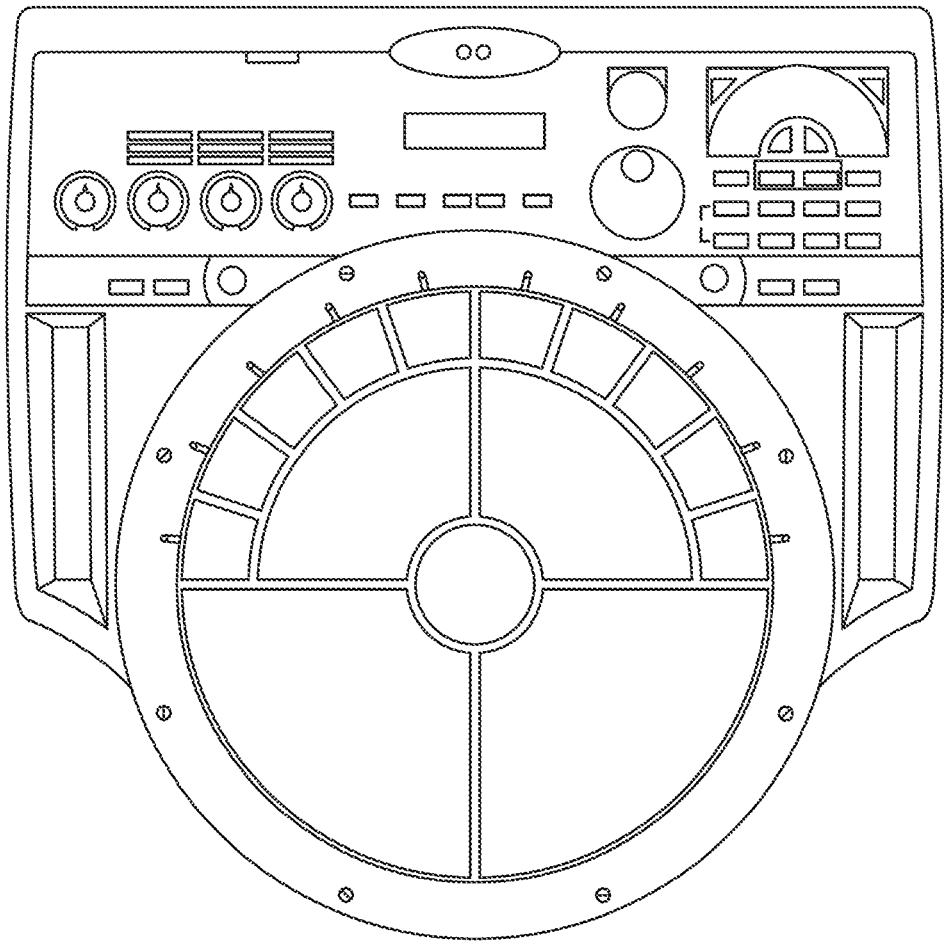
FIG. 1 PRIOR ART
FIG. 1 depicts a first percussion controller in the prior art.
Figure 2:
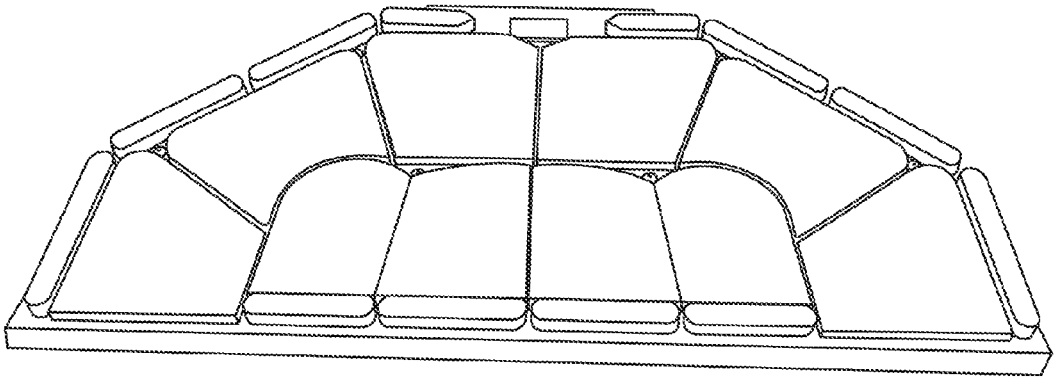
FIG. 2 PRIOR ART
FIG. 2 depicts a second percussion controller in the prior art.
Figure 3:
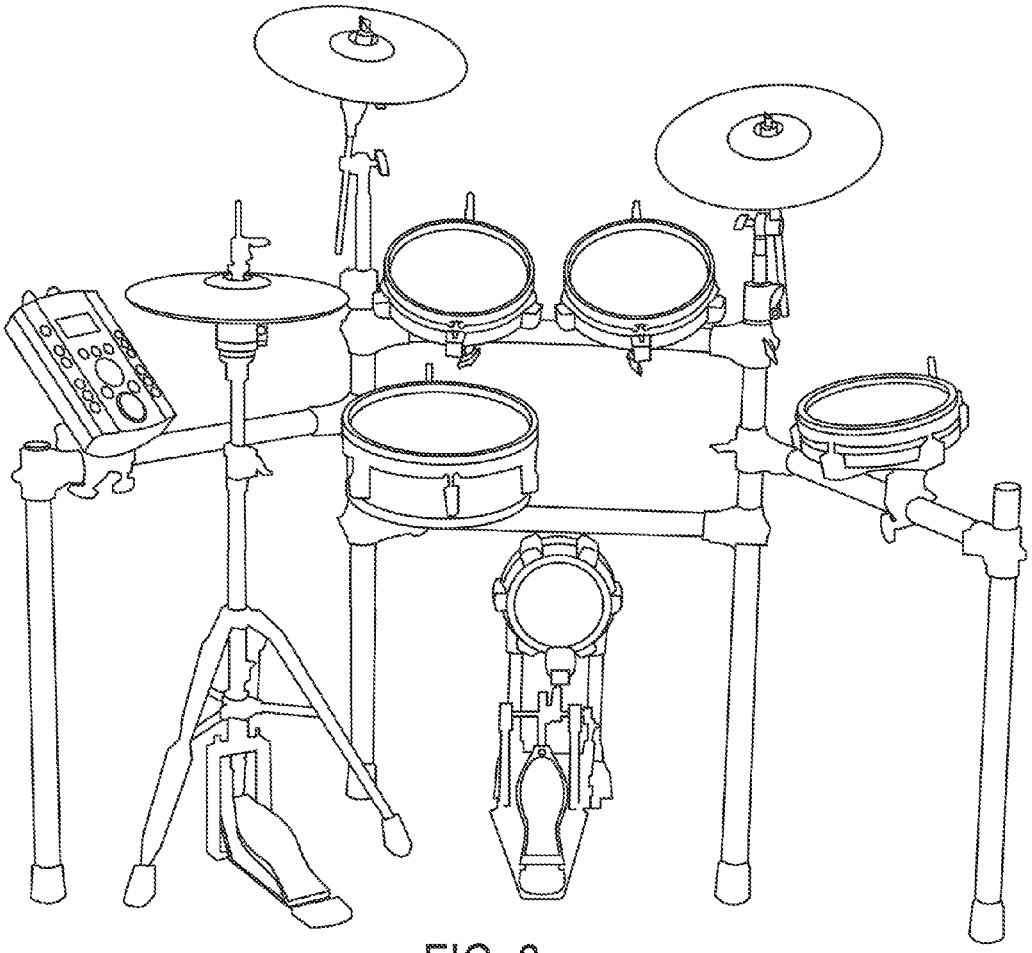
FIG. 3 PRIOR ART
FIG. 3 depicts a third percussion controller in the prior art.

Although presented in the specific context of a percussion controller, the teachings of the present invention can be adapted to other applications, for example, and without limitation, to other human/computer interfaces such as touch panels, plasma panels, switch panels, computer keyboards, control panels, sound-mixing controls, or stage-lighting controls.

Definitions

The terms appearing below are defined for use in this disclosure and the appended claims as follows:

"Impact" means any physical contact, regardless of the severity thereof, between, for example, the instrumented striker and the sensor-enabled striking surface. Thus, a forceful "whack" as well as the gentle pressure of brushing movement are both "impacts."

"Instrumented mat" means a mat that is capable of controlling the sensor-enabled striking surface. For example, striking the instrumented mat at a first location can change the layout of a particular instrument simulated by the sensor-enabled striking surface and striking the instrumented mat at a second location can change the instrument that is simulated by the sensor-enabled striking surface.

"Instrumented Striker" means a striker that includes devices/sensors that enable its kinetics to be determined for use, for example, with IN processing. In alternative embodiments in which striker force and position are determined based on measurements obtained through EM interrogation, the striker might not contain any sensors, etc. In such embodiments, "tags" that provide a reflective surface at the wavelength of the interrogating radiation can be present on the external surface of the striker. Such a "tagged" striker is considered to be an "instrumented striker," as that term is used herein. The term "instrumented striker" collectively references a stick, mallet, beater, glove, etc.

"Inter-network" means the wireless or wired communication network between the devices external to percussion controller and the percussion controller's processor, such as synthesizer(s), computer(s), other music controllers, and other percussion controllers.

"Intra-network" means the wireless and wired communication network of the percussion controller's "edge" devices: foot switches, trigger sensors, sensor-enabled striking surface, instrumented mat(s), processor, strikers, cradle(s), and indicator panel(s).

"MIDI" means "Musical Instrument Digital Interface," which is an electronic musical instrument industry specification that enables a wide variety of digital musical instruments, computers and other related devices to connect and communicate with one another. MIDI equipment captures note events and adjustments to controls such as knobs and buttons, encodes them as digital messages ("musical event messages"), and transmits these messages to other devices where they control sound generation and other features.

"Musical event" means something related to a musical performance, such as, a sound reproduced by a particular instrument, a musical note, tempo, pitch, volume (i.e., amplitude), and the like.

"Sensor-enabled striking surface" means a layer of material having an upper surface that is intended to be struck by a striker. The layer of material, or at least a portion of it, is configured to provide a rebound or bounce when struck by the striker. That is, the material is elastic or resilient, or otherwise configured to provide such resilience. Sensors that are capable of sensing the impact or touch pressure of the striker on the upper surface are disposed beneath the upper surface. The sensors can be either within the layer of material or directly beneath it.

"Striker" means an object that a performer strikes/touches to the sensor-enabled striking surface. The term "striker" collectively references a drum stick, a mallet, a beater, a gloved hand, etc.

Figures 4A, 4B:
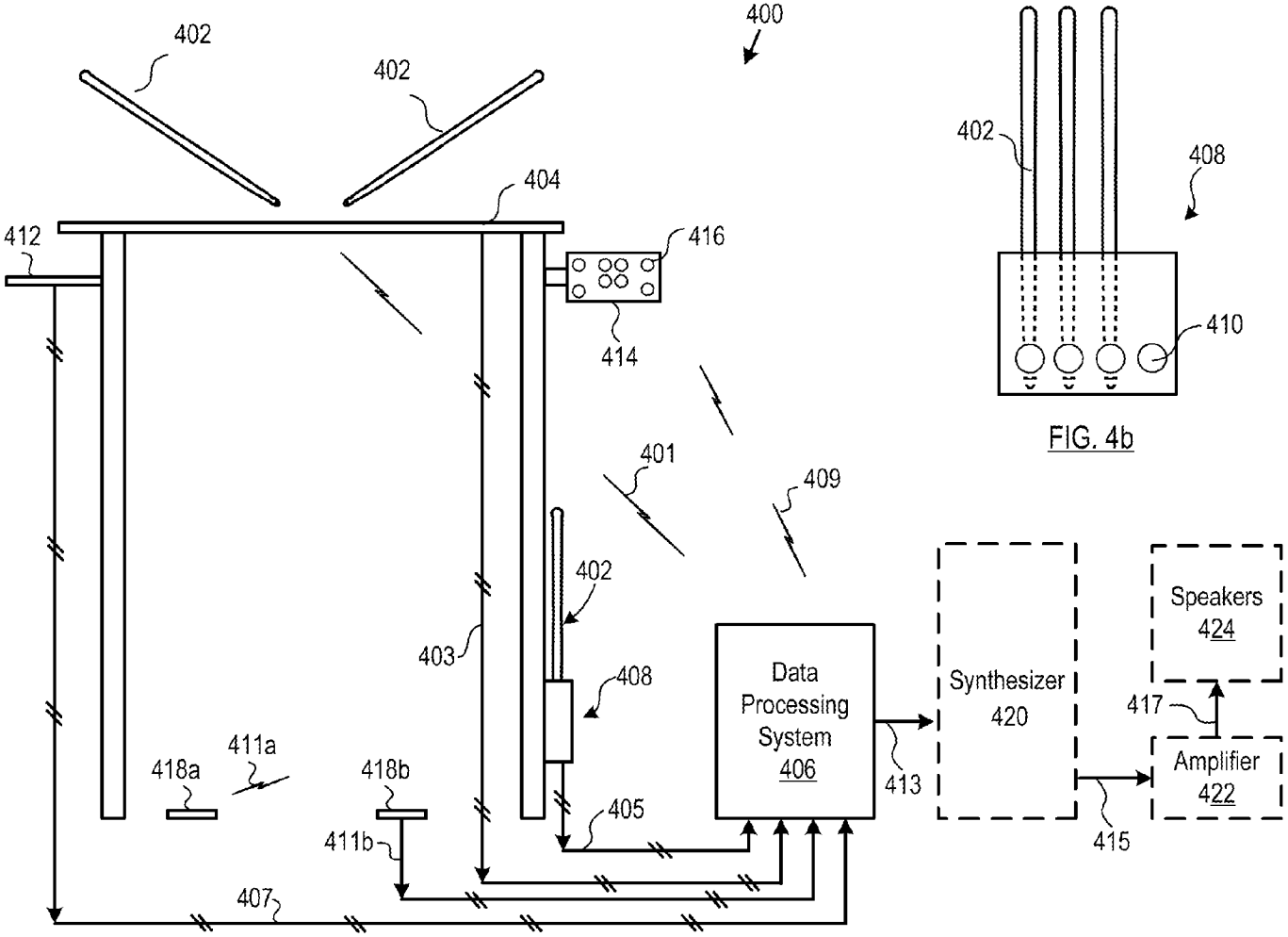
FIG. 4*a* depicts percussion controller 400 in accordance with the illustrative embodiment of the present invention.
FIG. 4*b* depicts a charging cradle for charging a rechargeable energy source within the instrumented strikers of percussion controller 400.

FIG. 4*a* depicts percussion controller 400 in accordance with the illustrative embodiment of the present invention. Percussion controller 400 includes instrumented strikers 402, sensor-enabled striking surface 404, data processing system 406, and striker cradle 408. Also depicted in FIG. 4*a* as part of percussion controller 400 are optional instrumented mat(s) 412, indicator panel 414, and foot pedal(s)/switch(es) 418. Percussion controller 400 is depicted in use with several devices that are not part of the percussion controller; that is, synthesizer 420, amplifier 422, and speaker(s) 424.

In the illustrative embodiment, information about the kinetics of the instrumented striker 402 is obtained via inertial sensing from on-striker devices. That information is wirelessly transmitted, via wireless communications link 401, to data processing system 406. Applying Inertial Navigation techniques, the data processing system uses the inertial measurements to predict the force with which instrumented striker 402 will impact sensor-enabled striking surface 404. In some embodiments, such information is also used to predict the location that instrumented striker 402 will impact sensor-enabled striking surface 404. Instrumented striker 402 is described in more detail in conjunction with FIG. 5, sensor-enabled striking surface 404 is described in more detail in conjunction with FIGS. 6*a-c* and 7*a-d*, and data processing system 406 is described in more detail in conjunction with FIGS. 8-10.

After mapping the predictions to virtual impact zones of sensor-enabled striking surface 404, data processing system 406 generates musical event messages, which are conveyed by signals 413 to music synthesizer 420. The musical event messages control synthesizer 420 in known fashion, causing it generate music signals 415 that are transmitted to amplifier 422 for amplification. The amplified music signals 417 are then transmitted to speakers 424, to actually generate the desired sounds; that is, the musical performance.

Instrumented strikers 402 that are not in use ("cold") reside in charging cradle 408. The cradle is operable to recharge a rechargeable energy source within each cold instrumented striker 402. In the illustrative embodiments, charging is performed inductively. In some embodiments, charging cradle 408 includes plural indicators 410, as shown in FIG. 4B, that provide an indication of the state of charge of instrumented strikers 402. Indicators 410 can be lights, wherein the state of the light (i.e., on or off) indicate charge. Alternatively, three lights each of different color, such as "red" (for depleted), "orange" (for partially charged), and "green" (for fully charged), can be used to indicate the charge state for each instrumented striker.

To facilitate recharge, charging cradle 408 senses, via appropriate circuitry/sensors, the presence of an instrumented striker 402 before charging. The cradle transmits signals to data processing system 406 over communications link 405. The signals convey information pertaining to the presence and state of charge of any instrumented strikers within charging cradle 408. In the illustrative embodiment, communications link 405 is wired; in some other embodiments, this link is wireless. As discussed later in conjunction with FIG. 5, instrumented strikers include a coil (e.g., coil 536) in the tip thereof for inductive charging.

Indicator panel 414 includes indicators 416 (e.g., lights, etc.) that provide an indication of the state of charge of the instrumented strikers that are currently in use ("hot") by the performer. The state of charge of hot instrumented strikers is tracked by data processing system 406. The state of charge can be estimated by time-in-use or hot instrumented strikers can transmit the state of charge to data processing system 406. The data processing system transmits, via communications link 409, a signal to indicator panel 414 that conveys the status of the hot instrumented strikers. Indicator panel 414 can also provide an indication of the status of other elements of percussion controller 400.

Optional instrumented pad 412 is used, in some embodiments, to supplement the capability of sensor-enabled striking surface 404. Instrumented pad 412 is a simply a smaller version of the sensor-enabled striking surface. Instrumented pad 412 communicates with data processing system 406 over wired communications link 407.

In the illustrative embodiment, percussion controller 400 includes one more foot switch(es) 418*b* that control some aspects of the operation of sensor-enabled striking surface 404 and/or instrumented pad 412. For example, foot switch 418*b* can be used to change the layout of a particular instrument being simulated by sensor-enabled striking surface 404 (e.g., change the location of drums, etc. within a "virtual" trap set, etc.) by simply choosing from among several pre-programmed arrangements. For example, a first "click" on the switch provides a first layout and the second "click" on the switch provides a second layout. Or foot switch 418*b* can be use to change the instrument being simulated by the sensor-enabled striking surface. Again, it is simply a matter of "clicking" between pre-programmed selections. Foot switch 418*b* communicates with data processing system 406 over wired communications link 411*b*.

Additional capability can be provided to the system via external pedal(s) 418*a*. Such pedals, which are conventional for electronic percussion systems, can, for example, actuate a virtual bass drum, etc. Pedal(s) 418*a* communicates with data processing system 406 over wireless communications link 411*a*. After reading the present disclosure, those skilled in the art will know how to integrate and use external pedal(s) 418*a* and foot switch(es) 418*b* with percussion controller 400.

Instrumented Striker 402.

Figure 5:
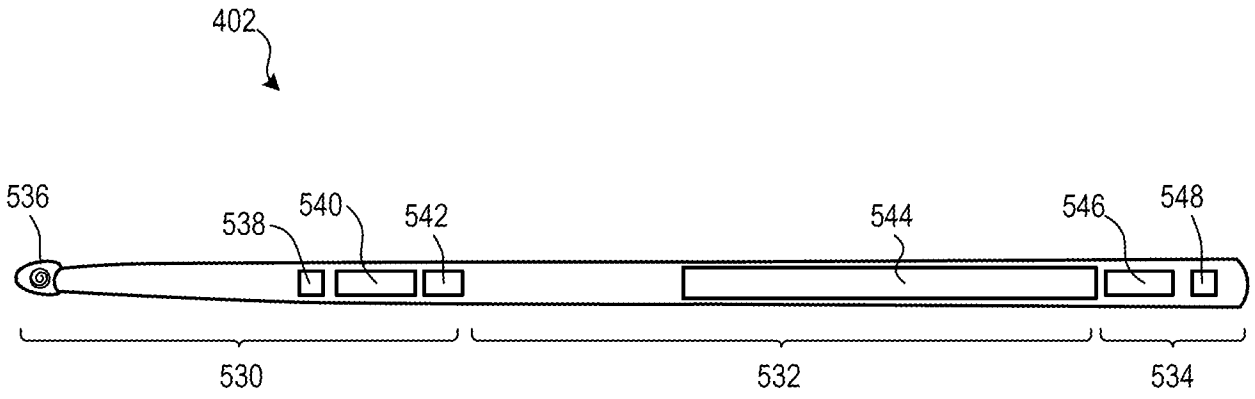
FIG. 5 depicts an instrumented striker of percussion controller 400.

Referring now to FIG. 5, instrumented striker 402 in accordance with the illustrative embodiment of the present invention comprises inductive coil 536, two 3-axis accelerometers 538 and 548, antenna 540, 3-axis digital compass 542, rechargeable energy source 544, and low power transmitter and logic circuits 546.

In the illustrative embodiment, instrumented striker 402 is about the same size as a conventional striker. For example, a 5B standard drum stick is 16 inches in length and 7/16 inches in diameter. The location of the center-of-gravity should be about the same for both instrumented striker 402 and a conventional striker.

In the illustrative embodiment, instrumented striker 402 comprises three sections: tip/taper section 530, shank 532, and butt 534. The diameter of each section near the interface to the adjacent section is appropriate for sliding one into the other and then bonding the adjacent sections together. As depicted in FIG. 5, coil 536 is disposed in the tip of tip/taper section 530. Accelerometer 538, antenna 540, and digital compass 542 are disposed in the taper of tip/taper section 530. Rechargeable energy source 544 is disposed in shank 532, and transmitter and logic circuits 546 and accelerometer 548 are disposed in butt 534.

It will be appreciated that sections 530, 532, and 534 must be hollow or include hollowed-out regions to receive the various components. If any of the sections are hollow, after the components are positioned therein, fill is provided to prevent components from moving and to achieve the proper weight and weight distribution for striker.

For inertial measurements, instrumented striker 402 includes at least one 3-axis accelerometer and at least one angular acceleration sensor ("AAS"). Accelerometer 538 measures acceleration of the striker's reference frame along each of three orthogonal axes: up/down, left/right, forward/back.

Accelerometers do not resolve all the forces present on the three axes (i.e., throwing force, gravity, and angular acceleration [centripetal] forces). Another measurement device, such as an AAS, is required so that angular acceleration forces acting on the striker can be resolved, leaving gravity and the throwing forces combined. Using the fixed rotation, measured at initialization, between the Earth's magnetic field and the gravity field, local gravity can be accurately resolved, such that the throwing forces on instrumented striker 402 can be isolated. In the illustrative embodiment, the AAS is 3-axis digital compass 542.

3-axis digital compass 542 measures the attitude of the instrumented striker frame with respect to the Earth's magnetic field. This information is used, in the illustrative embodiment, to provide angular accelerations for roll, yaw, and pitch about the instrumented striker's frame axes and provides a reference to accurately calculate the direction of Earth's gravity field. As an alternative to digital compass 542, a 3-axis gyroscope can be used. Due to the concerns as to the affect of repeated forceful impacts of instrumented striker 402 on sensor-enabled striking surface 404, digital compasses are currently preferred over gyroscopes.

A second 3-axis accelerometer 548 is used to decrease measurement errors, thereby improving the accuracy of calculations based on the measurements obtained from these devices. Alternatively, a second AAS device (e.g., 3-axis digital compass) could be used.

In some alternative, but less preferred embodiments, the kinetics of the striker is determined by interrogating the striker with electromagnetic energy ("EM"). For example, in some embodiments, a high speed camera is used to track the movements of the strikers during a performance. The images from the camera are then processed and, using IN, the force and/or location of a strike is predicted. In additional embodiments, very high frequency (e.g., $K_u$ band, etc.) radio can be used to interrogate the strikers. The energy is projected at the striker's tip and butt locations and, for example, the Doppler shift is measured at multiple sensors (a minimum of three) and processed in known fashion (e.g., triangulation, etc.) to obtain striker velocities and derive the striker positions, etc., either augmenting or replacing the IN processing. The location of the EM emitters is important so that the percussionist does not obstruct the emissions. In conjunction with the present disclosure, those skilled in the art will be able to make and use such alternative embodiments of the invention.

Information pertaining to the kinetics of instrumented strikers 402 must be transmitted to the data processing system without interfering with percussion performance techniques. To that end, in the illustrative embodiment, instrumented striker 402 includes wireless transmitter/logic circuits 546 and compact antenna 540 for transmitting the measurements obtained by accelerometers 538 and 548 and digital compass 542 to data processing system 406. The logic circuits implement link-layer logic and the conventional wireless physical link.

Power is required to operate transmitter and logic circuits 546. To that end, instrumented striker 402 includes rechargeable energy source 544. In the illustrative embodiment, the rechargeable energy source is a capacitor (e.g., super capacitor, etc).

Rechargeable energy source 544 must be routinely recharged. In the illustrative embodiment, metal coil 536 is disposed within the tip of instrumented striker 402 to facilitate inductive charging of rechargeable energy source 544 in charging cradle 408. Coil 536 is electrically coupled (not depicted) to rechargeable energy source 544.

In some other embodiments, instrumented striker 402 includes an energy-harvester, such as a piezoelectric crystal, etc., which charges the rechargeable energy source. The energy harvester captures energy, such as the energy released as the instrumented striker impacts sensor-enabled striking surface 404 and uses that energy to power the on-striker electronics. In such embodiments, the resiliency/elasticity of the resilient surface of sensor-enabled striking surface 404 is appropriately tailored so that a desired amount of the energy available from the strike is absorbed by deflection of the mat leaving a suitable amount of energy available for harvesting.

Although not depicted, some embodiments of percussion controller 400 include an instrumented glove (e.g., to be worn on the hands for hand percussion, etc.). The instrumented glove includes: (i) two or six accelerometers (one for each finger and one redundant); (ii) one or five 3-axis digital compasses (one for each finger); (iii) a replaceable energy source (e.g., a battery); (iv) a low-power transmitter and matched compact antenna; and (v) circuits to implement a link-layer logic and the conventional wireless physical link.

The Sensor-Enabled Striking Surface 404.

Figure 6A:
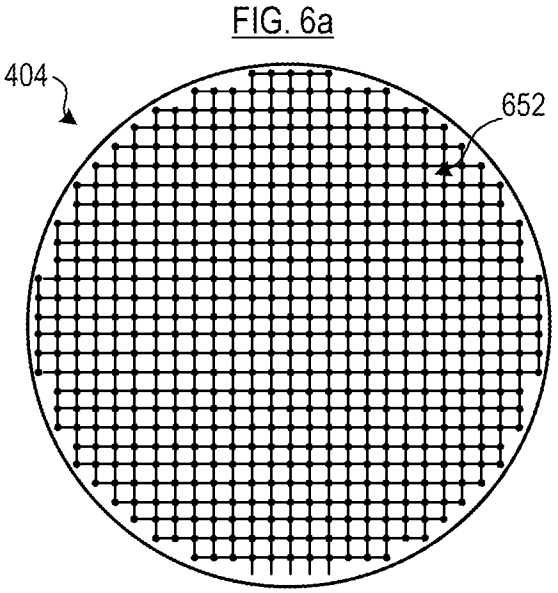
FIG. 6*a* depicts a top view of a first embodiment of a sensor-enabled striking surface of percussion controller 400.
Figure 6B:
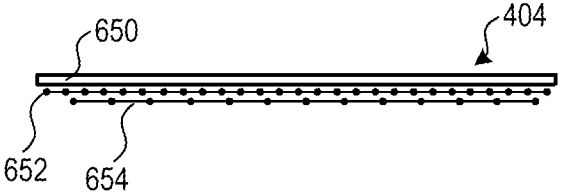
FIG. 6*b* depicts a side view of the sensor-enabled striking surface of FIG. 6*a*.
Figure 6C:
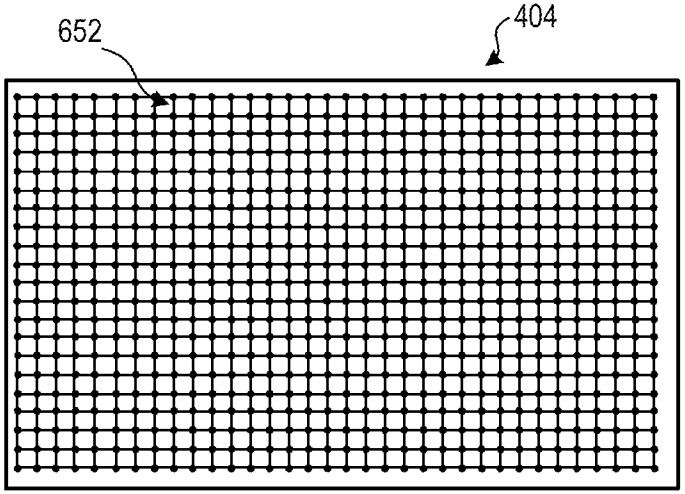
FIG. 6*c* depicts a top view of a second embodiment of a sensor-enabled striking surface of percussion controller 400.

FIGS. 6*a* and 6*b* depict, via top and side views, a first embodiment of sensor-enabled striking surface 404. In this embodiment, the sensor-enabled striking surface has a round shape, like a drum head. In some other embodiments, such as one shown in FIG. 6*c*, sensor-enabled striking surface 404 has a rectangular shape. The sensor-enabled striking surface can have any of a variety of forms as convenient.

Referring again to FIGS. 6*a* and 6*b*, sensor-enabled striking surface 404 comprises resilient striking surface 650, sensor mesh 652, and light mesh 654, arranged as depicted.

Resilient striking surface 650 provides a "rebound" upon striker impact, thereby mimicking the rebound response of an actual acoustic percussive instrument (e.g., drum heads, etc.).

Mesh of individually-addressable contact (force/pressure) sensors 652 underlies resilient striking surface 650. The contact sensors can be strain gauges, load cells, or the like, such as commercially available from Tekscan, Inc. of Boston, Mass. Sensor mesh spacing is typically less than about 2 centimeters, and more preferably less than about 1 centimeter. The smaller the spacing between sensors, the greater number of zones can be established on the striking surface.

Mesh of individually-addressable lights 654 underlies sensor mesh 652. The lights are positioned in the space between adjacent sensors. The use of the lights is discussed later in conjunction with FIGS. 7A through 7D.

Although not directly used for force and/or location determination of a strike, sensor-enabled striking surface 404 provides certain important functionality. In particular, sensor mesh 652 is used for at least the following purposes:

Initialization for IN calculations;

IN error correction; and

Verification of striker impact (i.e., force and/or predicted impact location).

As will be appreciated by those skilled in the art, IN needs to be initialized before it is used and requires ongoing error corrections. In accordance with the illustrative embodiment of the present invention, initialization and navigation error correction are accomplished by striking sensor-enabled striking surface 404. Data processing system 406 keeps track of each striker's state of initialization and the estimated error, and every strike or touch on the sensor-enabled striking surface can be used to fix the navigation solution.

As discussed further below, to relate the (predicted) location of a strike of instrumented striker 402 to a musical event, sensor-enabled striking surface 404 is "virtually" segregated into a plurality of impact zones via data processing system 406. More particularly, the data processing system "virtually" segregates sensor mesh 652 into impact zones. Each such impact zone typically represents a different musical event. Prior to a first performance, a user programs, in conjunction with data processing system 406, a variety of impact zone arrangements. The arrangements are stored in data processing system 406. A desired arrangement is recalled by the performer before a performance.

Figure 7A:
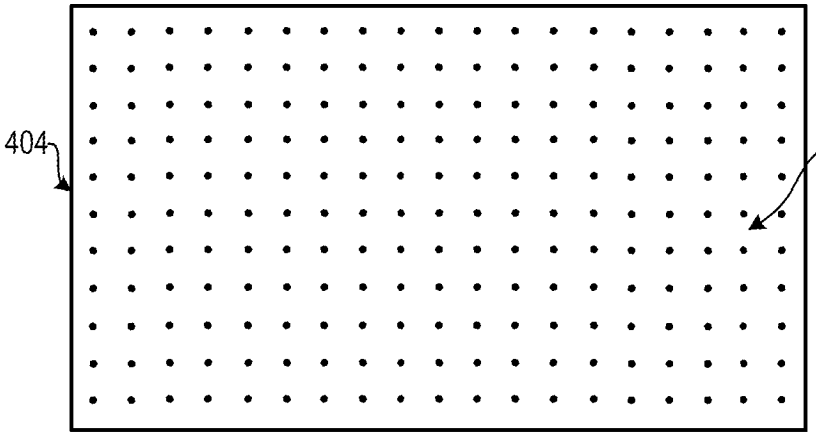
FIG. 7*a* depicts a top view of the sensor-enabled striking surface of FIG. 6*c* wherein lights for identifying impact zones are shown.
Figure 7B:
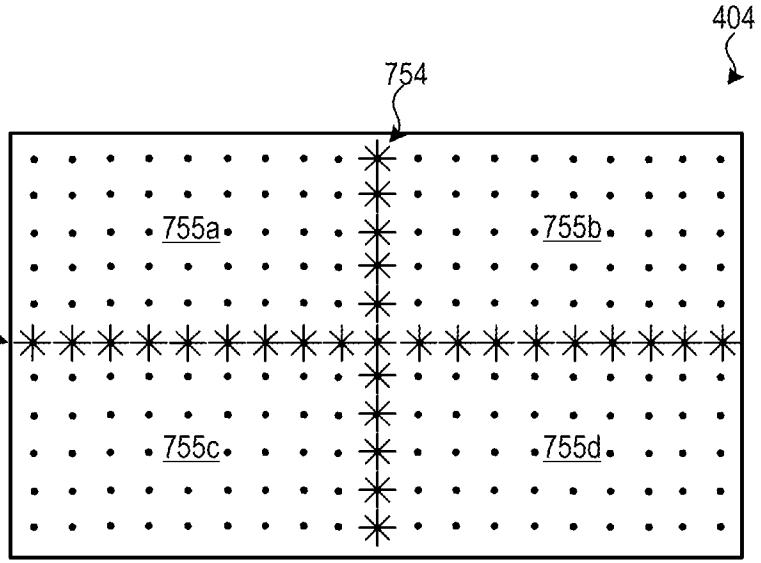
FIGS. 7*b*-7*d* depict a top view of the sensor-enabled striking surface of FIG. 7*a* wherein different groups of lights are illuminated to identify different arrangements and sizes of impact zones.
Figure 7C:
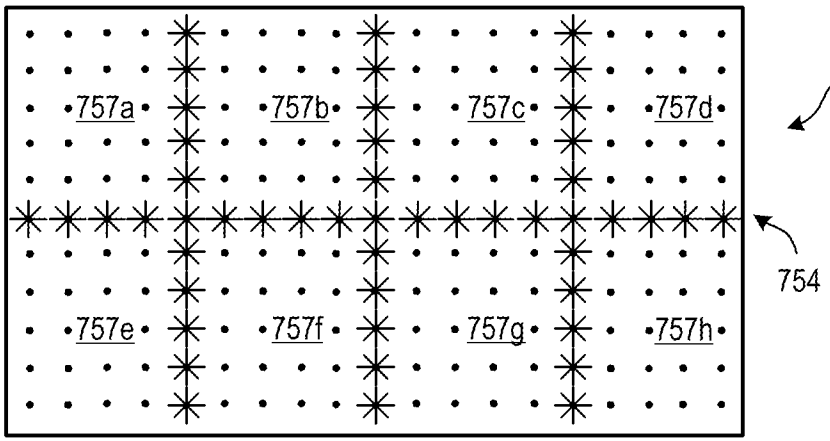
Figure 7D:
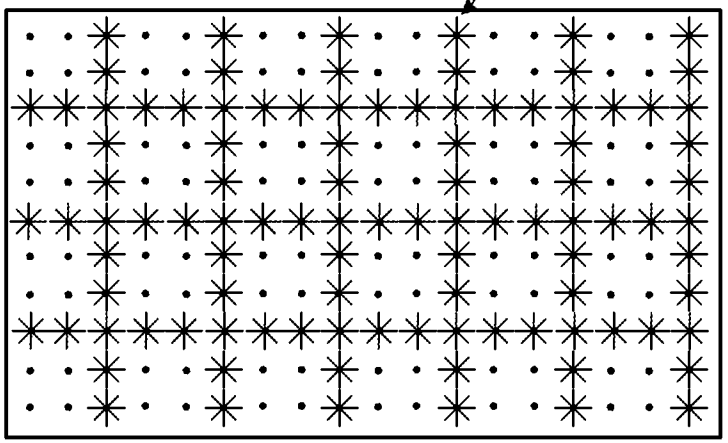

In the illustrative embodiment, data processing system 406 selectively activates lights within the mesh thereof to display the boundaries of the impact zones for the performer. FIG. 7*a* depicts a top view of sensor-enabled striking surface 404 showing (un-lit) lights 654. FIGS. 7*b* through 7*d* depict arrangements of impact zones of increasing complexity. The layout of each arrangement is revealed by activated lights 754.

FIG. 7*b* depicts an arrangement having four impact zones, 755*a* through 755*d*. FIG. 7*c* depicts an arrangement having six impact zones, 757*a* through 757*f*. And FIG. 7*d* depicts an arrangement having twenty-four impact zones. The various impact zones can map to different instruments, or different regions on an instrument, or both.

Sensor-enabled striking surface 404 will typically have dimensions of 14 inches×32.5 inches, 25 inches×32 inches, or 25 inches×39 inches, although other sizes are acceptable. A master percussionist can reliably strike within a square region that is about 1% on a side. With a sensor-enabled striking surface 404 having dimensions of 25 inches×32 inches, 252 impact zones can be created.

The location and force predictions of the "strike" will be issued a few milliseconds before actual impact on sensor-enabled striking surface 404. As a consequence, prediction accuracy will be very high, but there remains the possibility of extremely infrequent prediction errors. In such cases, at the time of impact, data processing system 406 might determine that there was a prediction error wherein:

(1) Synthesizer 420 begins to generate the wrong note; or (2) Synthesizer 420 begins to generate the right note but with the incorrect force.

The solution to scenario "2" is to do nothing. "MIDI" velocity is used to convey "force" (at 127 different energy levels) and most force errors will be very small and barely noticeable in the generated sound. Scenario "1" represents the more significant error. The "note" error must be corrected; an uncorrected note will detract from the musical performance. The processor will issue a "note-off" command to the synthesizer for the wrong note. This is followed by a "note-on" command for the correct note. The result of this will be a barely perceptible, several-millisecond "click" sound (due to the incorrect note) followed by the sounding of the correct note.

It is notable that IN error reduction is well established; many conventional techniques are known and applicable to achieve one-in-a-million occurrences of error. Two textbooks that are particularly useful to an understanding of the IN algorithms, causes of IN error and rates of occurrence, and IN error correction techniques are: Britting, Kenneth R. "Inertial Navigation Systems Analysis" (ISBN-13 978-1-60807-078-7) and Bekir, Esmat "Introduction to Modern Navigation Systems" (ISBN-13 978-981-270-765-9).

The dependence of the predictive aspects of the present invention on making very accurate IN predictions is the reason why it is preferable to use two accelerometers, rather than one, in a stick/mallet/beater and up to six accelerometers, rather than five (one for each finger) in a glove. The extra accelerometer provides information critical to reducing errors.

In some alternative embodiments, the striking surface is not sensor-enabled; it is simply a resilient striking pad. In such embodiments, an auxiliary instrumented pad is used to provide the initialization and updating functions. Since the percussionist would have to occasionally strike the auxiliary instrumented pad during a performance, such embodiments are less desirable than the illustrative embodiment in which the striking surface is instrumented. Furthermore, in such embodiments, the percussion controller will not be able to correct prediction errors.

Data Processing System 406.

Figure 8:
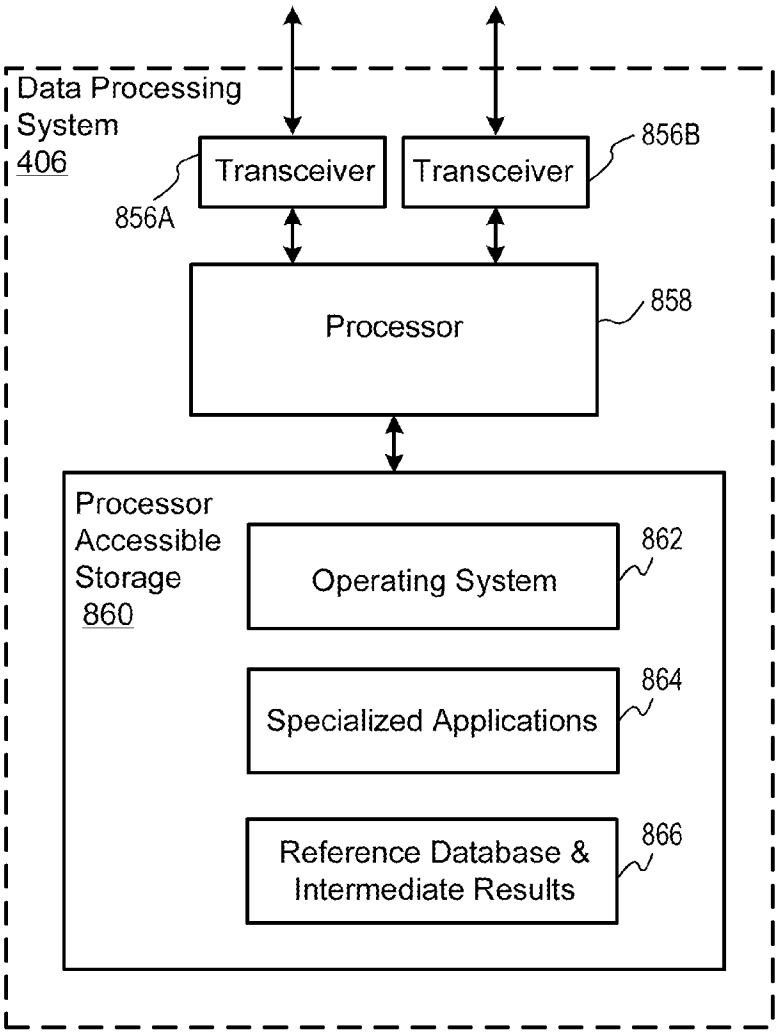
FIG. 8 depicts a block diagram of the salient components of an illustrative hardware platform for the data processing system of percussion controller 400.

FIG. 8 depicts a block diagram of the salient components of an illustrative hardware platform for implementing data processing system 406. In the embodiment depicted in FIG. 8, data processing system 406 comprises transceiver 856A and 8556B, processor 858, and processor-accessible storage 860, interrelated as shown.

Transceiver 856A is a wireless transceiver (including antenna, not depicted) and transceiver 856B is a wireline transceiver. These transceivers enable data processing system 406 to (i) transmit information-conveying signals to other elements of percussion controller 400 and (ii) to receive information-conveying signals from such other elements. For example, in the illustrative embodiment depicted in FIG. 4*a*, transceiver 856A is used for communications with instrumented strikers 402 and indicator panel 414. Transceiver 856B is used for communications with sensor-enabled striking surface 404, charging cradle 408, and instrumented pad 412. In some other embodiments, percussion controller 400 includes additional wireless and/or wireless transceivers. For example, in some of such embodiments, one wireless transceiver is used for communications between data processing system 406 and instrumented striker 402, another wireless transceiver is used for communications between data processing system 406 and indicator panel 414. It will be clear to those skilled in the art, after reading this specification, how to make and use transceivers 856A and 856B.

In the illustrative embodiment, processor 858 is a general-purpose processor that is capable of, among other tasks, running Operating System 862, executing Specialized Applications 864, and populating, updating, using, and managing Reference Data and Intermediate Results 866 in processor-accessible storage 860. In some alternative embodiments of the present invention, processor 858 is a special-purpose processor. It will be clear to those skilled in the art how to make and use processor 858.

Processor-accessible storage 860 is a non-volatile, non-transitory memory technology (e.g., hard drive(s), flash drive(s), etc.) that stores Operating System 862, Specialized Applications 864, and Reference Database and Intermediate Results 866. It will be clear to those skilled in the art how to make and use alternative embodiments that comprise more than one memory, or comprise subdivided segments of memory, or comprise a plurality of memory technologies that collectively store Operating System 862, Specialized Applications 864, and Reference Database and Intermediate Results 866.

It is to be understood that FIG. 8 depicts one embodiment of data processing system 406; a variety of other hardware platforms or arrangements can suitably be used. For example, system 406 can be implemented in a virtual computing environment. In some embodiments, multiple processors can be used, wherein different processors execute different Specialized Applications. The use of multiple processors may be advantageous or necessary as a function of the rate at which information is being processed.

Furthermore, in some embodiments, the various elements of data processing system 406 are co-located with one another. In some other embodiments, one or more of the elements is not co-located with the remaining elements. For example, in some embodiments, processor-accessible storage 860 is not co-located with processor 858.

Figure 9:
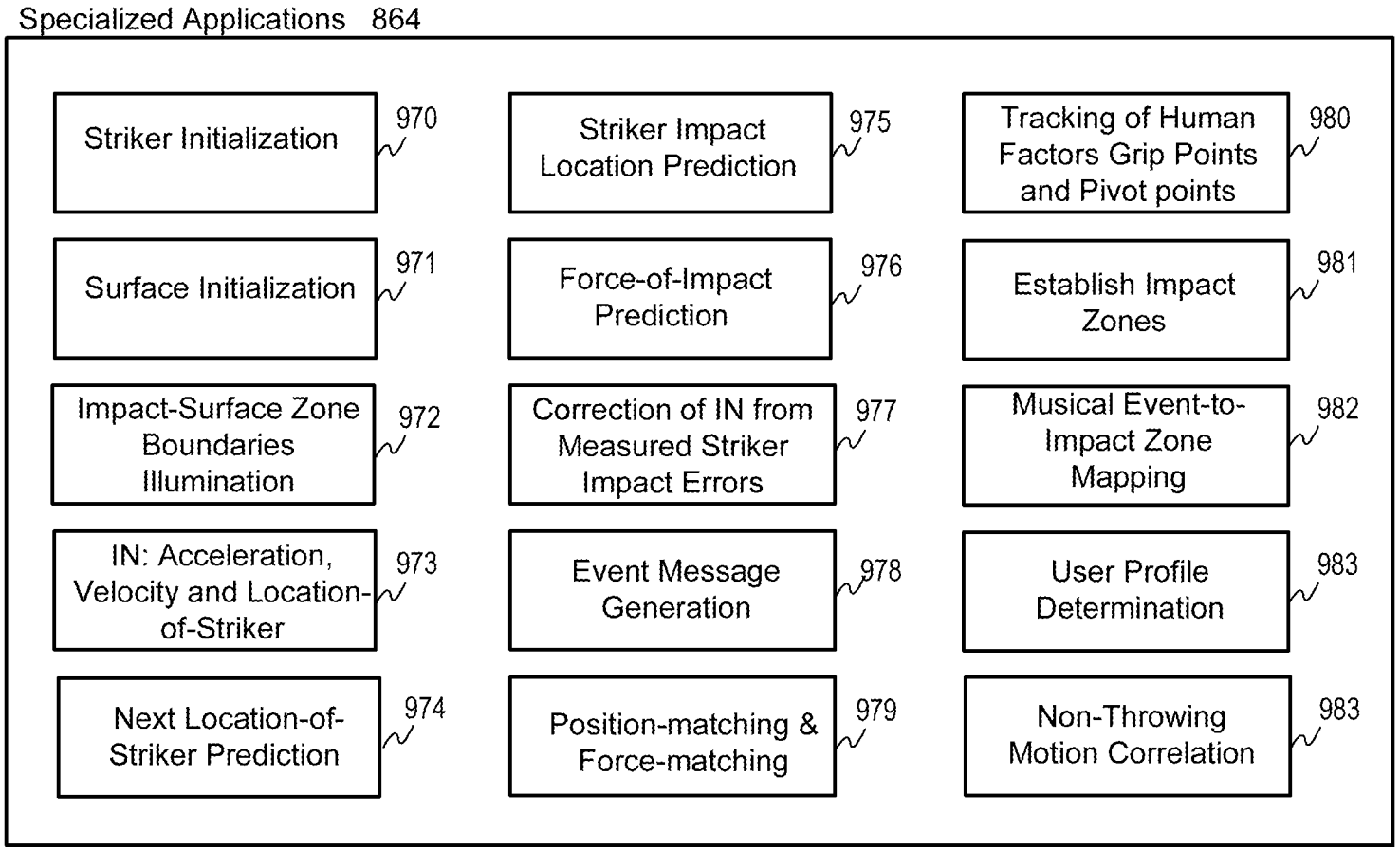
FIG. 9 depicts specialized software applications that are maintained in the data processing system's processor-accessible storage and used by the data processing system to perform the method depicted in FIG. 11.

FIG. 9 depicts the contents of Specialized Applications 864. The routines stored in this "component" of processor-accessible storage 860 enable percussion controller 400 to perform the various tasks for required for operation, including, without limitation, the prediction of the force and location of the impact of instrumented striker 402, mapping of impact zones to musical events, as well as keeping track of all the strikers that are actively being used, setting the computational priority of IN on active strikers, background tracking on dropped strikers and on strikers that are recharging in the cradle, as well as to perform various optional tasks.

The software routines stored in Specialized Applications 864 include the following:

Striker Initialization 970. This routine determines the initial conditions required for IN calculations. This routine requires data obtained by touching instrumented striker 402 to sensor-enabled striking surface 404. Also, rolling the instrumented striker on the sensor-enabled striking surface will reveal any misalignments in the 3-axis sensors (i.e., accelerometers 538 and 548 and digital compass 542). As required, corrections can be applied during processing to account for any such misalignments.

Surface initialization 971. This routine determines where (geographically) sensor-enabled striking surface 404 is residing and its altitude. This establishes the orientation of sensor-enabled striking surface 404 with respect the Earth's gravity and magnetic fields. This routine utilizes latitude and longitude data, GPS readings, input from Performance Locations Profile 1092 and Geocentric Dataset 1093 as available in Reference Database 866 within processor-accessible storage 860, etc., to the extent available.

Impact-Surface Zone Boundaries Illumination 972. This routine illuminates the appropriate lights in light mesh 654 to demarcate the boundaries of the impact zones established on sensor-enabled striking surface 404. The pre-defined Zone Boundaries 1085 are recalled from Reference Database 866 within processor-accessible storage 860.

Inertial Navigation: Acceleration, Velocity, and Location-of-Striker 973. With every sensor sample from instrumented striker 402, inertial navigation calculations are performed to predict striker location.

Next Location-of-Striker Prediction 974. This routine use the results of routine 973, which performs the IN computations for acceleration, velocity, and location-of-striker to then predict the future location-of-striker at exactly the next sequential time when the striker's sensor will again be sampled (or forward to two sample cycles in the future). If the predicted future location-of-striker is not entirely above the sensor-enabled striker surface 404, then the time of impact is computed and then the predicted future location-of-striker is computer for the condition of bouncing off sensor enabled striking surface 404. If the time of impact is computed, then Striker Impact Location Prediction 975 must be run using this time of impact parameter.

Striker Impact Location Prediction 975. This routine predicts the striker impact location based on the time of impact solution obtained from Next Location-of Striker Prediction 974 (usually the striker's velocity, etc.). The predicted location is mapped into an appropriate pre-defined impact zone, as obtained from Zone Boundaries 1085 in Reference Database 866 within processor-accessible storage 860.

Force-of-Impact Prediction 976. This routine predicts the force of impact of instrumented striker 402 on the sensor-enabled striking surface using the location prediction obtained via routine 975. That is, based on the predicted location, the velocity of the striker at impact, etc., the force of impact is predicted.

Correction of Inertial Navigation from Measure Striker Impact Errors 977. This routine compares the actual location (and optionally force) of the instrumented striker's impact with the predicted values. To the extent any discrepancy that is deemed significant is observed, corrective parameters are computed and then provided to IN routine 973, which performs the correction on the next (sampling) cycle.

Event Message Generation 978. Having mapped the predicted strike location to a impact zone via routine 975, this routine accesses Musical Event Mappings 1087 from Reference Database 866 to correlate the impact location to a musical event.

Position-Matching and Force Matching 979. These routines track a performer's technique and enable comparison to Reference Throwing Techniques 1088 in Reference Database 866. These routines are also used to build User Profile 1090 in Reference Database 866.

Tracking of Human Factors Grip Points and Pivot Points 980. This routine persists a history of results from IN routine 973 and then performs a calculation of the grip pivot point of the striker. A history of up to about 5000 results of the grip pivot points is used with IN routine 973 computations to compute the wrist pivot, elbow pivot and shoulder pivot point locations.

Establish Impact Zones 981. This routine is used prior to performance to create pre-defined impact zones. The predefined impact zones are stored in Zone Boundaries 1085 in Reference Database 866.

Musical Event-to-Impact Zone Mapping 982. This routine maps musical events to impact zones. This routine is used prior to performance in conjunction with the pre-defined Zone Boundaries 1085 in Reference Database 866 to create Defined Musical Event Mappings 1087.

User Profile Determination 983. This routine performs statistical averages of the information from Tracking routine 980 to supply generalized parameters for grip pivot, wrist pivot, elbow pivot, and should pivot for User Profile 1090 in Reference Database 866.

Non-throwing Motion Correlation 984. This routine persists a history of results from IN routine 973, and then performs a correlation matching algorithm on that history against a record of acceleration, velocity, and location-of-striker pre-recorded patterns. When the correlation result exceeds a threshold value, the musical event associated with that pattern is issued to Event Message Generation 978.

Figure 10:
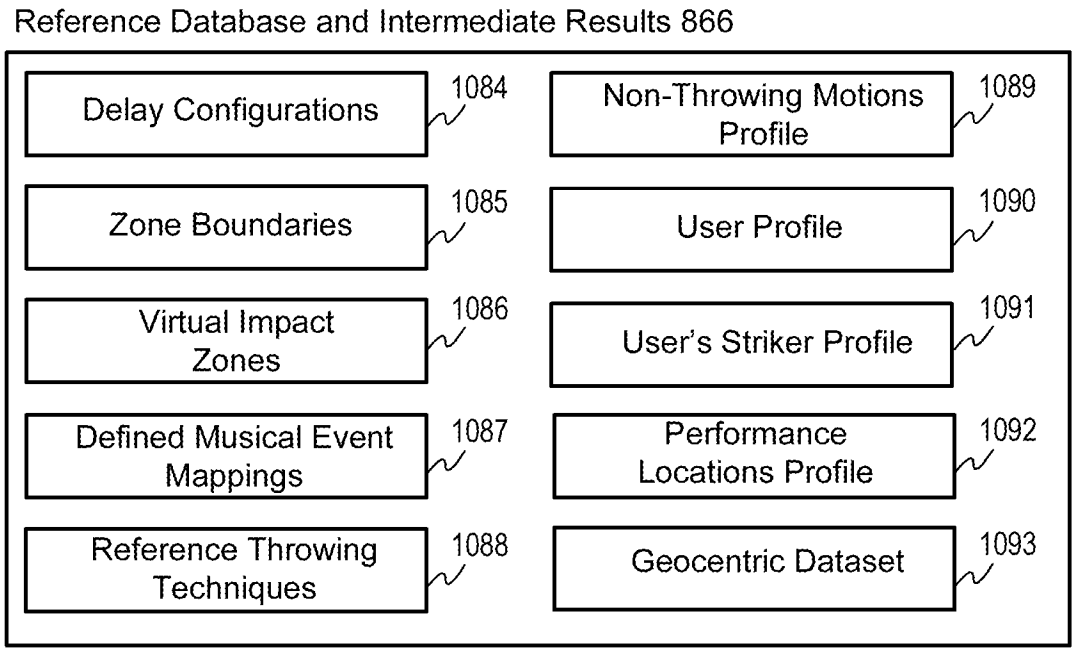
FIG. 10 depicts reference information that is maintained in data processing system's processor-accessible storage and used by the specialized software applications to perform required processing.

FIG. 10 depicts the contents of Reference Database and Intermediate Results 866 in processor-accessible storage 860. The information stored in Reference Database 866 are accessed by many of the routines comprising Specialized Application 864. The information stored in Reference Database 866 include:

Delay Configurations 1084. Parameters (both preprogrammed factory presets and user defined data) to set up the anticipated delays from the user's MIDI equipment and sound generation equipment, including musical event message transmission and routing devices, computers with musical event latencies, and sound generation hardware with signal processing latencies. These transmission, sound-generation processing, buffering delays are corrected by issuing musical event messages with a total pre-delay in advance of the actual impact that will eliminate unwanted delay.

Zone Boundaries 1085. Parameters (both preprogrammed factory presets and user defined data) to establish the boundaries of the impact zones on sensor-enable striking surface 404.

Virtual Impact Zones 1086. Parameters (both preprogrammed factory presets and user defined data) to establish the boundaries of the virtual zones not located on any Surface. These zones are then mapped to musical events.

Musical Event Mappings 1087. Parameters (both preprogrammed factory presets and user defined data) to establish the mapping of both the physical impact zones (on a Surface) and the virtual (not on a Surface) zones to the musical event that shall be issued for that zone.

Reference Throwing Techniques 1088. Preprogrammed data for instructional applications; data that provide expert throws of the striker for comparison and reference by the user.

Non-Throwing Motions 1089. Profile Parameters (both preprogrammed factory presets and user defined data) to establish the definitions for non-throwing striker motions, such as muting a cymbal, muting a ringing drum, conducting like a baton to a tempo, or conducting like a baton for a volume swell.

User Profile 1090. User defined data for the historical human factors associated with throwing and bouncing strikers, such as striker grip points, wrist and elbow pivot radii, shoulder pivot radius, etc.

User's Striker Profile 1091. Parameters (both preprogrammed factory presets and user defined data) that keep historical data about each of the strikers used or associated to the system, including Striker unique identification codes, historical 3-Axes sensor alignments, Striker warp, and Striker sensor sensitivity.

Performance Locations Profile 1092. Parameters (user defined data) that keep data about frequently used locations of the system where performance or rehearsal would occur, and any corrections of the default geocentric data at that location. For example, frequent locations might be at home, band rehearsal, 5th St. Grill, etc. . . .

Geocentric Dataset 1093. Preprogrammed factory data about the latitude, longitude, elevation, and magnetic flux direction at the Earth's surface.

Figure 11:
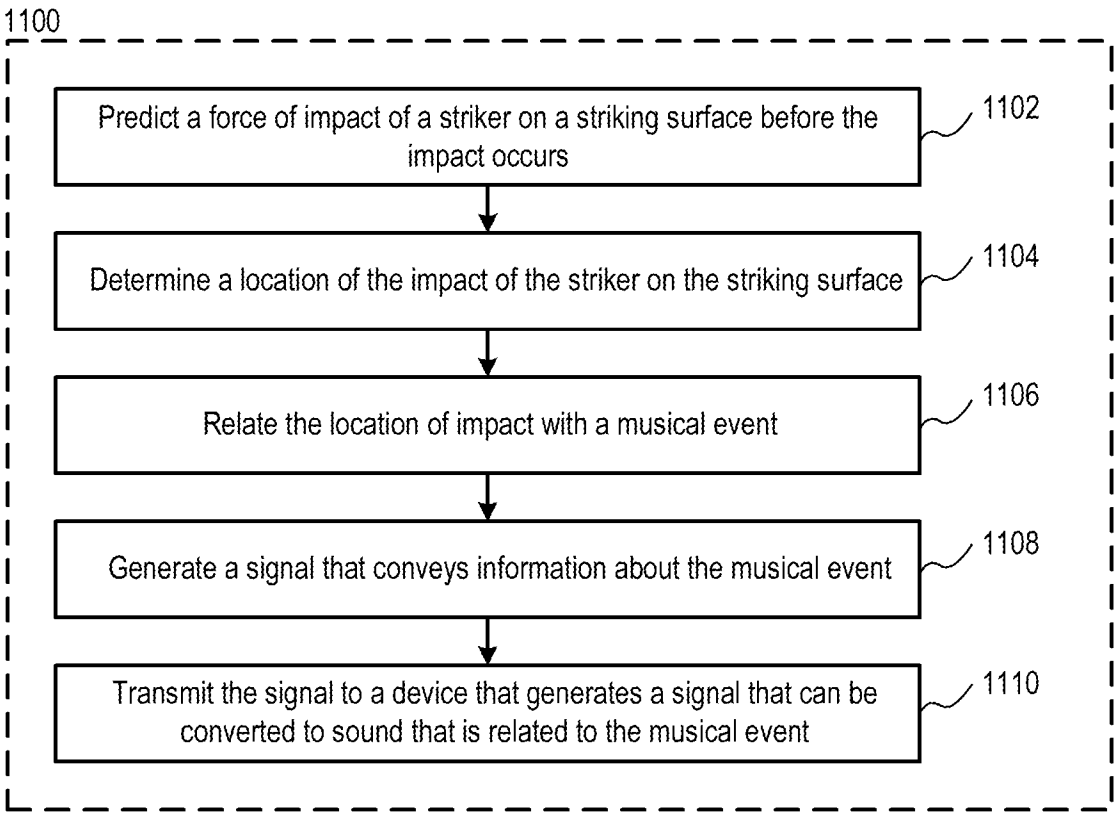
FIG. 11 depicts a block diagram of a method in accordance with the illustrative embodiment of the present invention.

FIG. 11 depicts method 1100 in accordance with the illustrative embodiment of the present invention. Task 1102 recites predicting a force of impact of a striker on a striking surface before impact occurs. As previously discussed, this task involves obtaining kinetics information about instrumented striker 402 and applying inertial navigation techniques thereto.

Task 1104 recites determining a location of impact of the striker on the striking surface. As previously discussed, in some embodiments, this task involves obtaining kinetics information about instrumented striker 402 and applying inertial navigation techniques thereto. In some other embodiments, the location of impact is measured on sensor-enabled striking surface 404; that is, only the force of impact is predicted.

Task 1106 recites relating the location of impact with a musical event. As previously disclosed, this task involves determining the impact zone on the sensor-enabled striking surface in which impact is predicted to occur, and determining the musical event that corresponds to an impact at that zone.

Task 1108 recites generating a signal that conveys information pertaining to the musical event. As previously discussed, this can be done in conventional fashion via MIDI protocol.

Task 1110 recites transmitting the signal to a device that generates a signal that can be converted to sound that is related to the musical event.

Additional considerations and details about some of the methods and routines disclosed herein are presented in conjunction with FIGS. 12*a-c* and 13 through 19.

Figure 12C:
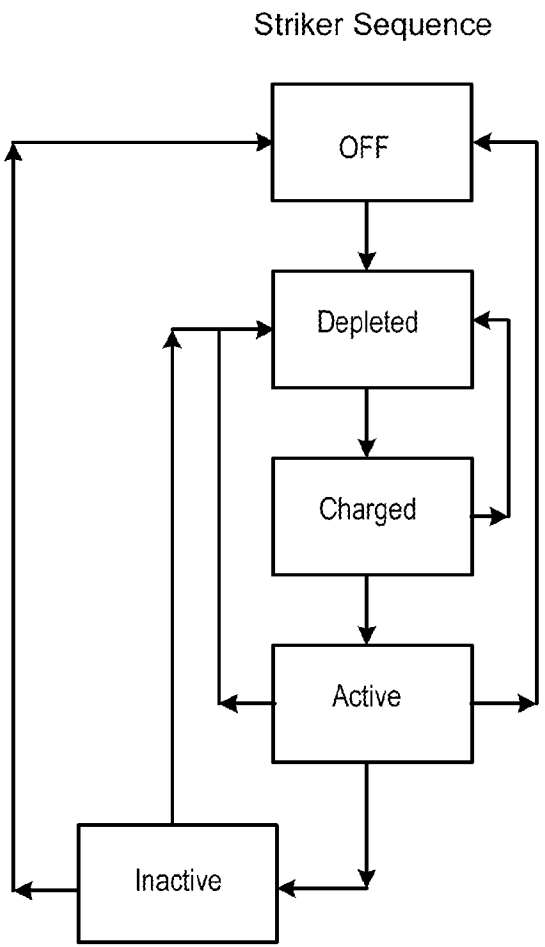
FIG. 12*c* depicts a high level sequence of the instrumented striker.
Figure 12B:
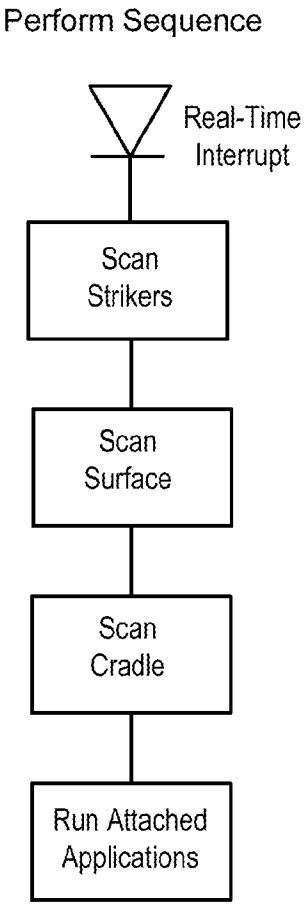
FIG. 12*b* depicts a high level processing sequence for use in conjunction with the illustrative embodiment of the present invention.
Figure 12A:
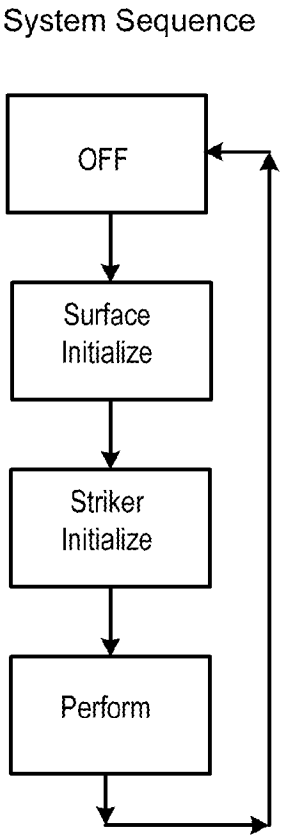
FIG. 12*a* depicts a high level system sequence in accordance with the illustrative embodiment of the present invention.

FIGS. 12*a* through 12*c* depict the sequence of system states and automatic processing. The system is in OFF State when it is de-energized. Packing, shipping, hauling, unpacking, and mechanical and electrical installation all occur in this state. During installation, assembly of sensor-enabled striking surface 404, charging cradle 408, and any other assemblies are mounted on a stand. (See, e.g., FIGS. 4*a* and 4*b*.) Power cables and electrical system cables are the connected. Instrumented strikers 402 are typically be placed in the charging cradle. When power is applied, the OFF state terminates, and Surface Initialization begins. When power is de-energized, the OFF state immediately resumes.

In the Striking Surface Initialize state, just after power is applied, instrumented strikers 402 in charging cradle 408 will begin receiving power, processor 858 (see, e.g., FIG. 8) begins booting operating system 862 and initializing various Specialized Applications 864. Indicator panel 414 and charging cradle 408 are initialized. Initialization requires input of external information for the latitude and longitude and elevation of the system, which could optionally be provided via wireless or wired USB communications to a GPS application on a handheld device, or through a user interaction using indicator panel 414. (See, e.g., FIG. 10, Performance Locations Profile 1092 and Geocentric Dataset 1093.)

Sensors of the sensor-enabled striking surface 404 take initial readings and set system parameters used during performance. The direction and strength of the gravity field to the Striking Surface frame is read via an included 3-axis accelerometer (not depicted in sensor-enabled striking surface). Alternatively, readings from the 3-axis accelerometer 538 (see, e.g., FIG. 5) in instrumented striker 402, which must be held motionless on the sensor-enabled striking surface, can be used instead. The magnetic attitude of the Striking Surface frame is read by an included digital compass (not depicted in sensor-enabled striking surface). Alternatively, readings from digital compass 542 in the instrumented striker, which must be held motionless on the sensor-enabled striking surface, can be used instead. The gravity attitude of the Striking Surface frame is computed from the gravity field calculation and the gravity field to the Striking Surface frame. The transceiver is initialized and, upon completion, processor 858 begins issuing a discovery request message to instrumented strikers 402. Other systems of percussion controller 400 in the vicinity may also respond to the discovery request. The system then proceeds to Striker Initialization state.

In the Striker Initialization state, as instrumented strikers 402 individually energize, they respond to the discovery requests, and processor 858 registers them in a Striker Protocol Table. Gradually, processor 858 reduces the rate of issuing discovery request messages and increases the rate of polling instrumented strikers 402 for data from their sensors. When instrumented strikers 402 report that they are fully energized, indicator panel 414 requests that the operator performs a Striker Initialization. For this process, each instrumented striker 402 is first placed motionless on sensor-enabled striking surface 404, and then rolled across the striking surface. After each instrumented striker is initialized, the system proceeds to the Performance state.

The Performance mode is a real-time loop of process execution control. Instrumented strikers 402 and sensor-enabled striking surface 404 must be sampled and processed at consistent rates of approximately 1000 Hz; that is, once per millisecond, in order to the achieve psychoacoustic performance criteria required by professional musicians.

The Performance mode processing loop (FIG. 12*b*) begins with scanning of sensor data from active instrumented strikers, then executing the inertial navigation computations for each such striker, computing the striker kinematics and predicting the striker impacts on sensor-enabled striking surface 404. In each polling cycle, one additional inactive instrumented striker 402 is polled for its status. In each polling cycle, a different inactive striker is polled for status.

Figure 13:
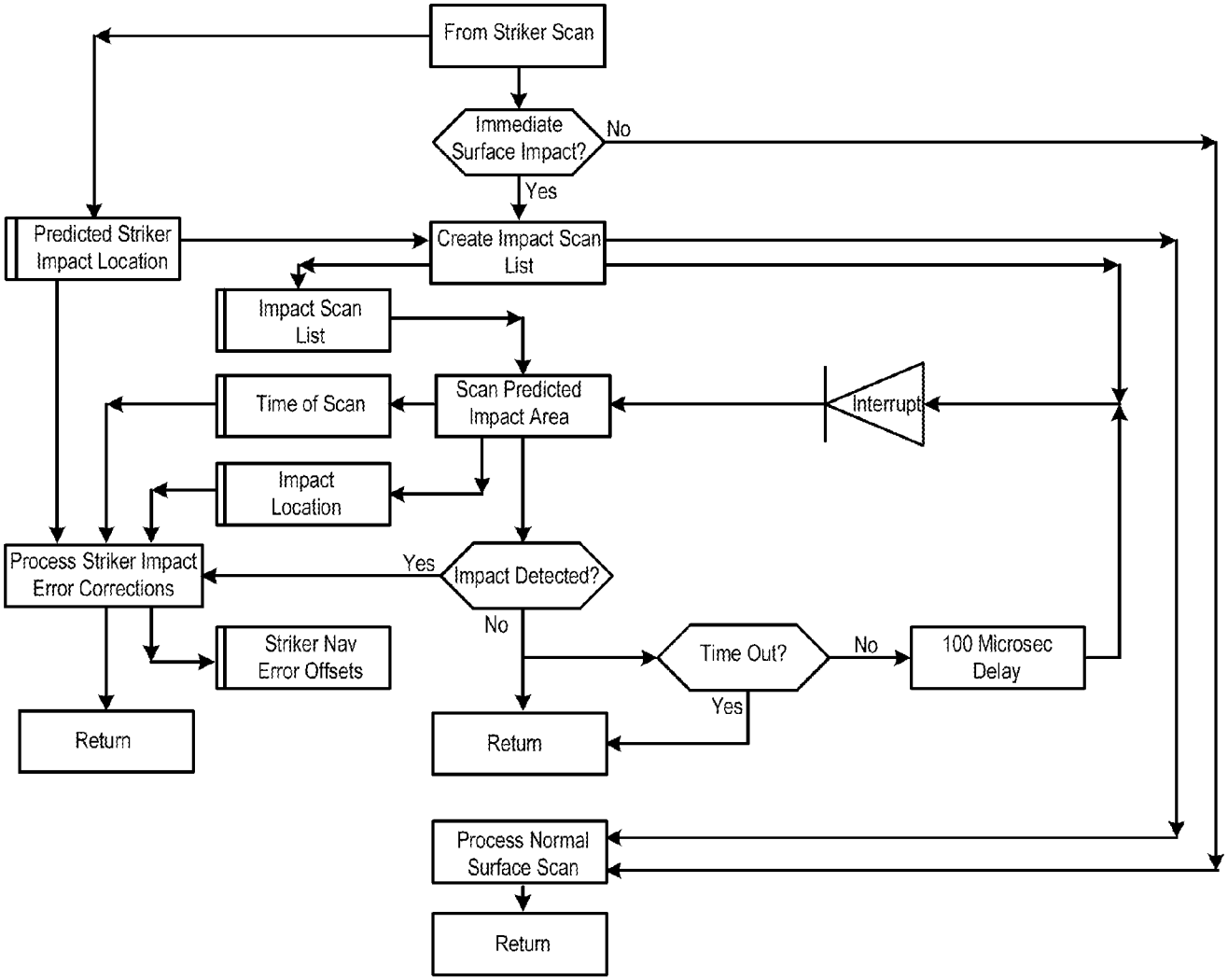
FIG. 13 depicts a block flow diagram of a method for scanning the sensor-enabled striking surface.

With continued reference to FIGS. 12*a* through 12*c*, and now referencing FIG. 13, the process of scanning the sensor-enabled striking surface is executed. From the striker scan it was determined if instrumented striker 402 would impact sensor-enabled striking surface in the next one or two update cycles along with the prediction for where on that surface the instrumented striker would impact. If there is no immediate surface impact predicted, then the processing continues for a normal surface scan proceeding sequentially through every row and column; measuring each sensor of sensor-enabled striking surface 404. This is performed between impacts to detect any finger touches that a performer uses, for example, to control the musical performance (e.g., muting a sound, etc.).

If an immediate surface impact predicted, then the prediction for where the striker would impact on sensor-enabled striking surface 404 is used to create an impact scan list of the sensors surrounding the predicted point of impact. Process control is then passed to the normal surface scan process, after triggering an immediate interrupt to scan the predicted impact area. The interrupt causes a process to scan the predicted impact area using the impact scan list, recording the time of the scan and the impact location if an impact is discovered.

If no impact is detected, a delay is triggered of approximately 100 microseconds to repeat interrupt to scan the predicted impact area. If an impact is detected, processing begins for that instrumented striker's impact to: calculate the error corrections (as necessary), recording the striker's Navigation error offsets to be used in future striker inertial navigation updates, and returning to the normal processing from the interrupt. To avoid an infinite interrupt loop, a time-out control is used to conditionally trigger the delayed interrupt.

Continuing with FIG. 12*b*, charging cradle 408 is scanned for the presence of instrumented strikers 402, and then passed to the application controller to run various Specialized Applications 864 in the remaining execution time left in the performance mode real-time cycle.

The instrumented striker sequence is depicted in FIG. 12*c*. Strikers are initially de-energized and may return to that state during the performance. The depleted state can occur during charging from a de-energized state or just from normal use in an active state during performance. In this state, there is insufficient stored energy in the striker to assure correct operation. A depleted striker can lose energy if it is not charged and will shut off. Through continued charging of the striker, the charged state is obtained. There are three sub-states: barely charged, adequately charged, and fully charged. These sub-states are useful indications to the performer for which instrumented striker 402 to select during emergencies (e.g., a dropped stick, etc.), so that a barely charged striker in hand may be swapped for a fully charged striker in charging cradle 408. An instrumented striker 402 that is not present in the charging cradle and that is sensed to be in motion is defined to be in the active state. An instrumented striker that is not present in the charging cradle and that is sensed to be without motion is defined to be in the inactive state. Active and Inactive strikers may become depleted over time. The depleted state should be indicated to the user via indicator panel 414.

Figure 14:
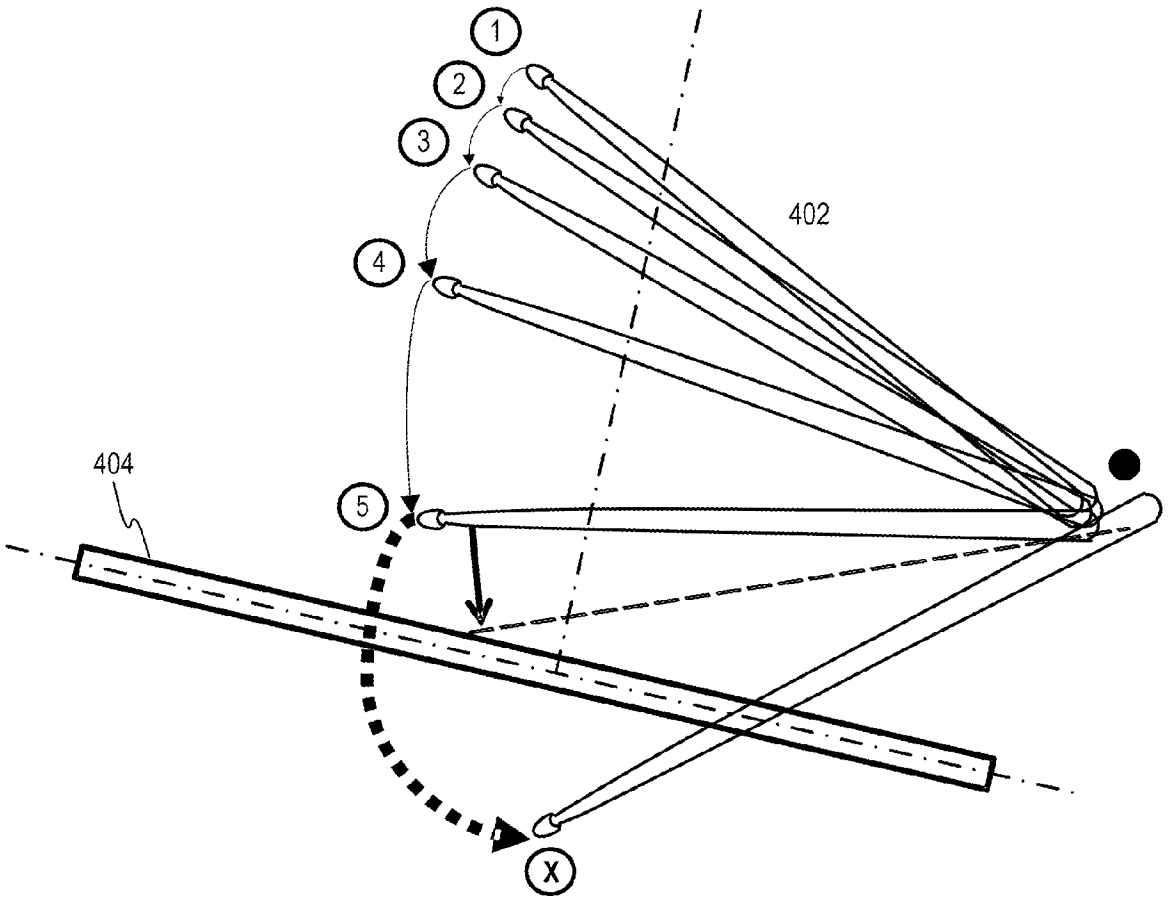
FIG. 14 depicts a throw as a sequence of instrumented striker positions and predicted locations in relationship to the sensor-enabled striking surface and its Surface Frame, resulting in a predicted impact time and location.

FIG. 14 depicts the prediction of the impact of instrumented striker 402 on a tilted sensor-enabled striking surface 404. The Striking Surface Frame ("SF") axes are shown overlaying the sensor-enabled striking surface 404 with the elevation axis perpendicular thereto. The perspective of FIG. 14, which is viewing into the left side of the sensor-enabled striking surface shows the mathematical relevance of the SF for making impact calculations.

In the SF, the calculated predicted locations of the instrumented striker trace points can be easily checked for a negative elevation (i.e., below the axes in the plane of the sensor-enabled striking surface). Both the elevation of the last striker trace point prior to impact (i.e., position "5" in FIG. 14) and the magnitude of the predicted negative elevation are used for precisely interpolating to the time and location of the striker's impact. This striker position is identified as "X," the dashed line indicating the projected location and time of impact. This information is used to compute predicted velocity of the instrumented striker at the time of impact (using the previously computed velocity at position 5). The velocity is used to compute predicted energy of impact using the known mass of the striker (i.e., $E=\frac{1}{2} mV^2$). Then the magnitude of the predicted negative elevation can again be used for predicting the elevation of the point of the actual instrumented striker after bouncing back (not depicted) from sensor-enabled striking surface 402. The call-out "X" indicates a next predicted position from the measured and computed velocity, where points along the striker trace have negative elevation in the Surface Frame. It is to be understood that at actual sample rates a professional percussionist's throw will have twenty or more samples taken and computed; the six positions shown in FIG. 14 are simply for pedagogical purposes.

With continuing reference to FIG. 14, the wrist pivot of the throw is illustrated in the Surface Frame point of view, which is a significant point of view for purposes of instructing throwing techniques. Specialized Applications for aiding instruction (e.g., Position-matching & Force matching 979, etc.) are optionally executed by the system to access the stream of Inertial Navigation computations and/or striker traces that can be, for example, recorded to an external bulk storage device, streamed over a network, or streamed to an external video display.

Figure 15:
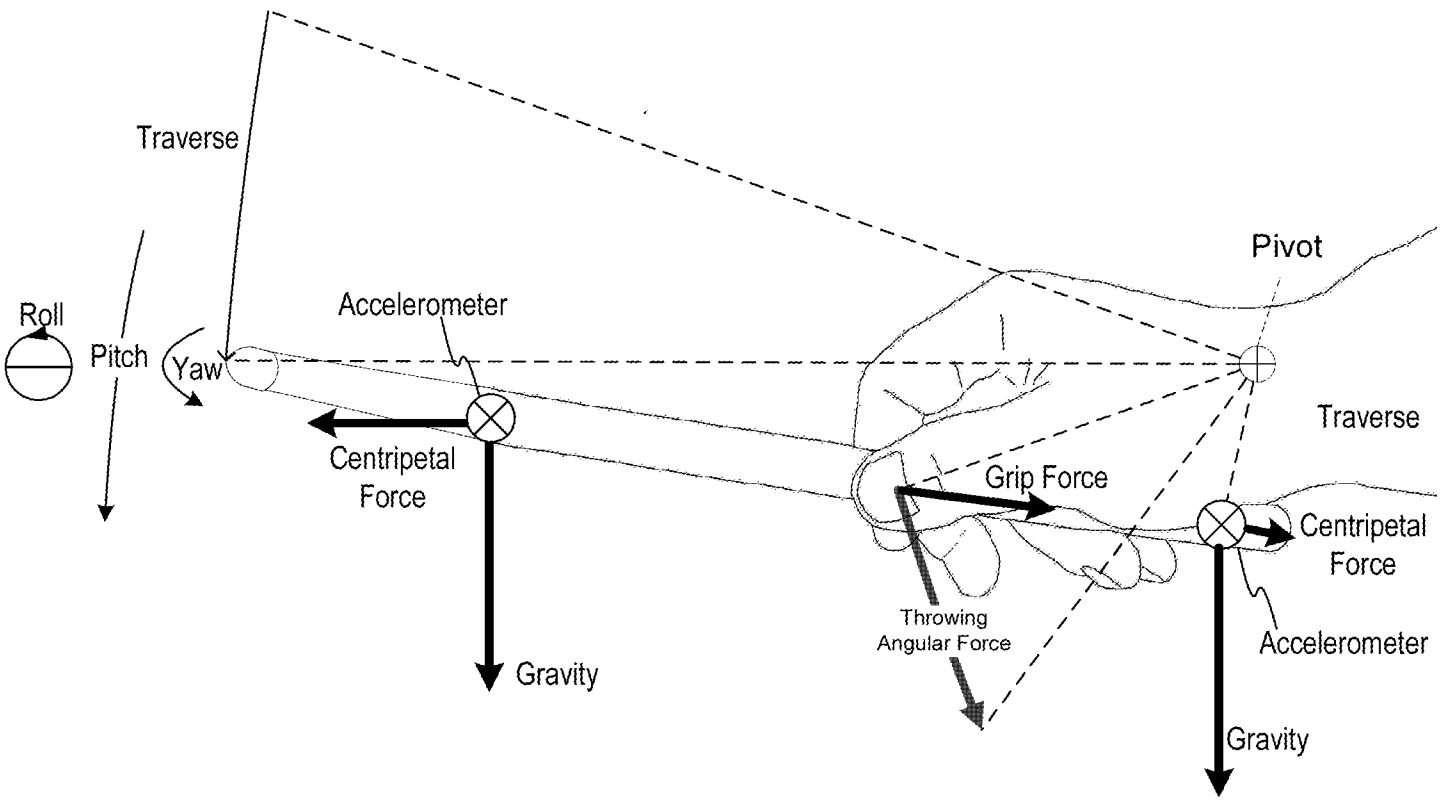
FIG. 15 depicts forces experienced by instrumented striker 402 during a throw.

FIG. 15 illustrates forces experienced by instrumented striker 402 during a throw, the important wrist pivot is in both the Striker Frame and the Surface Frame. The Grip Force between the Thumb and Pointer fingers counter balances the centripetal force of the mass at the center of gravity of the striker (not depicted). The throwing force on the instrumented striker is also applied between the Thumb and Pointer fingers. The accelerometers experience the same Gravity force and rotational torque about the wrist pivot, yet experience very different local centripetal forces.

The Inertial Navigation computations, as taught for example by Britting, address the centripetal and gravity force implications, but instructional value can also be derived from applications that assess these forces. For example, a rapid decrease in centripetal force can indicate the instrumented striker is slipping the grip, which could be detected by instructional applications. As another example, rolling the striker during a throw is inefficient and this could be detected by instructional applications. Also, immediately prior to impact there should be a release of the throwing force on the instrumented striker, which could be detected by instructional applications. Finally, the pivot of throw should remain stable in both the Striker Frame and the Striking Surface Frame which could be detected by instructional applications. Instructional applications would also be concerned with the accuracy of impact placement and timing that could make use of information from the surface impact scans. Parameters inside the Inertial Navigation computations or the surface scan procedures are made available to the instructional applications. The software architecture of the system provides, at minimum, Application Program Interfaces (API) for subscribing to the striker Inertial Navigation parameters or surface scan parameters.

To automate a throwing technique assessment for an instructional application, the primary rotational axis for each accelerometer is computed at every striker sample from a multitude of past samples. Then, calculating the short term weighted average of approximately 3 to 12 samples across both accelerometers, positional tracking algorithms are used to detect the nearness of the pivot to the Wrist Axis. This should be near the stick Butt, and of much shorter radius than an Elbow Axis. Additional calculations then utilize inertial navigation parameter streams to detect the pitching force about the wrist pivot and detect throwing-axis stability. These are recorded and can be displayed externally in real-time to the instructor and student.

Figure 16:
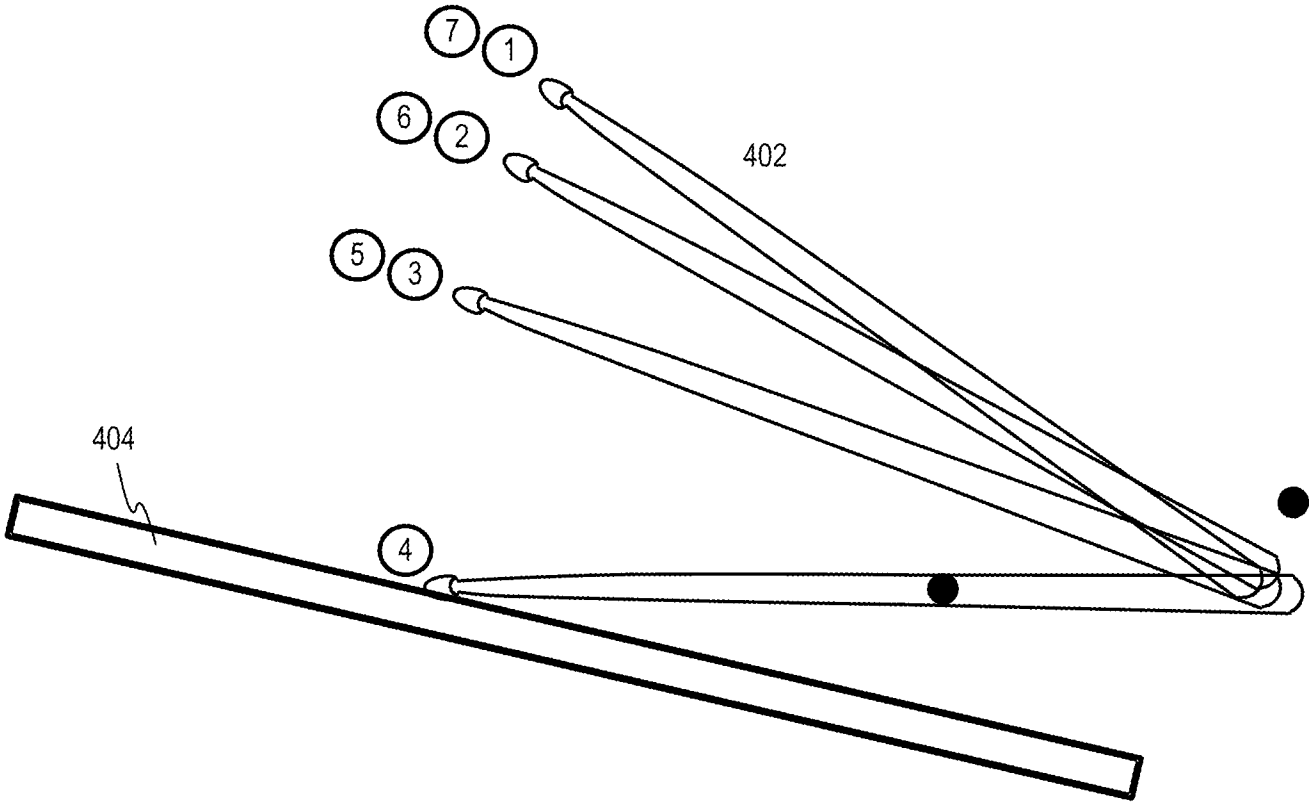
FIG. 16 depicts a sequence of instrumented striker positions and the shift of rotation during a throw.

FIG. 16 depicts a single stroke throw about wrist axis, wherein impact requires shifting the axis to the grip point. Instrumented striker 402 is allowed to pivot on impact about the grip point as the hand simultaneously reverses to lifting about the wrist pivot. The stick is then recovered, lifted about the wrist axis for the next throw. Positions 1, 2, and 3 depicts a sequence of throwing about the wrist pivot, position 4 in the sequence indicates impact bounce about the grip pivot, and positions 5, 6, and 7 in the sequence indicate lift about the wrist pivot. To automate a single-bounce-technique assessment for an instructional application, the primary rotational axis for each accelerometer is computed at every striker sample from a multitude of past samples. The primary rotational axis for each accelerometer (e.g., accelerometers 538 and 548) is computed at every sample from a multitude of samples, with the weighted averaging as discussed previously. During the bounce, the grip axis should be through the shank of the instrumented striker, approximately ⅓ of the distance from the striker butt. An improper grip is detected when the grip axis is underneath the instrumented striker (not through the striker) or at the wrong location along the length of the instrumented striker. The bouncing axis stability is recorded and can be displayed externally in real-time to the instructor and student. Additional instructional applications provide prerecorded master percussionist throws and bounces, which are correlated against the student's striker positions and velocities. Real-time and replay displays (external) of striker throws and bounces—master vs. student—are provided.

Figure 17:
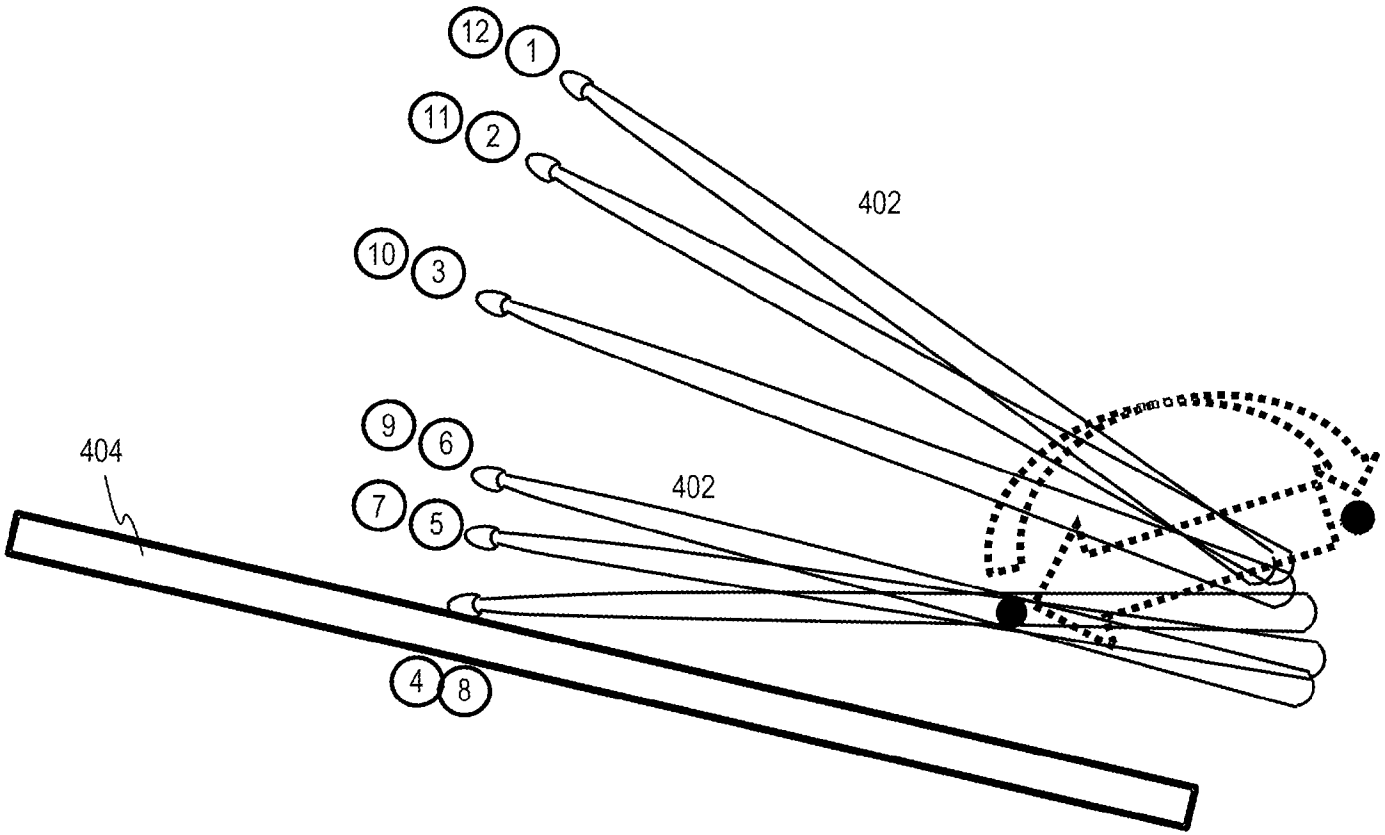
FIG. 17 depicts a sequence of instrumented striker positions and the shift of rotation during a rudimental bounce.

FIG. 17 illustrates a double stroke throw and bounce. After a throw about wrist axis (positions 1, 2, and 3), the first impact requires shifting the axis to the grip point (position 4). After the first impact against sensor-enabled striking surface 404, instrumented striker 402 is freely pivoting about the grip point (positions 5 and 6) when a double stroke pull is executed by the performer (i.e., a finger pulled bounce during positions 5, 6, and 7) reversing the rotation about the axis of the grip point. The stick is allowed to pivot following the second impact about the grip point (positions 8 and 9). Then the stick is lifted about the wrist axis for the next throw (positions 10, 11, and 12). The automation of a rudimental double bounce technique assessment follows similarly to the previously discussed single stroke throw assessment application, now with the additional capability to assess the timing of the finger pull forces to bounce the striker.

Figure 18:
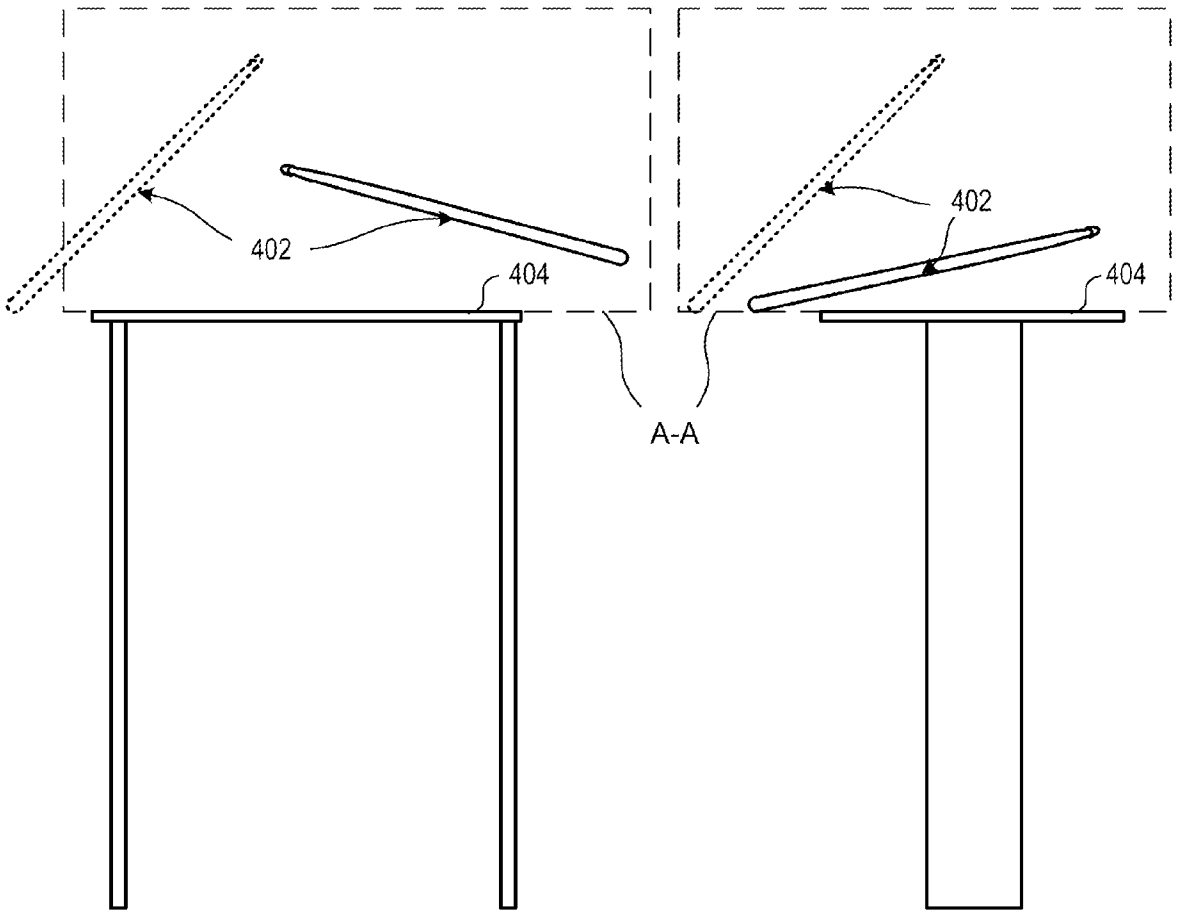
FIG. 18 depicts the space volume boundaries of the instrumented striker during performance.

FIG. 18 depicts the highly constrained volume of space where an instrumented striker will travel and for which accurate inertial navigation solutions are required. FIG. 18 depicts both a front and side view of the area around sensor-enabled striking surface 404. The striker volume A-A is shown as a dashed line to indicate the boundary for the right hand instrumented striker 402 (solid line). The striker volume for the left hand instrumented striker 402 (dashed line) is not shown. There is a natural overlap of the striker volumes. For a drum-set performance using a single sensor-enabled striking surface, each instrumented striker will require approximately 1.5 cubic meters of space, whereas the combined space for both instrumented strikers 402 is approximately 2 cubic meters. Active instrumented strikers should not be outside of this combined space during performance. Calculated elevations outside of the combined volume are a possible indication of the vertical divergence problem recognized by Britting. This would be indicated to the percussionist (e.g., via indicator panel 414 of FIG. 4*a*) and require re-initialization of that instrumented striker. A dropped instrumented striker exits the combined volume in a state of free-fall, so there will be no external forces being measured on the striker's accelerometers (only centripetal forces would be experienced and measured). Thus a dropped-striker condition can be detected. An instrumented striker that is removed from charging cradle 408 and then enters the combined volume requires initialization. In this case, there will be an indication to the percussionist on the indicator panel to initialize that particular striker.

The magnetic and gravitational fields should be constant in the combined striker volume. For the AAS approach to sensing motion of instrumented striker 402, this means that magnets and ferrous materials must not influence the uniformity of the magnetic field in the combined striker volume. Structural supports and stands should be made of non-ferrous material such as aluminum or carbon fiber composites. Loudspeakers will need to be kept approximately a few meters away from the combined striker volume. The performance location should not occur near structural steel beams or near metal walls because these might focus the Earth's magnetic field and distort AAS readings. One compensation that is possible for magnetic field distortion is to make measurements of the magnetic field across the combined volume during surface initialization, such as by using a conventional magnetometer device (not depicted). A mapping of the magnetic field in the combined volume is then created that is used during performance to correct the AAS readings based on the IN computed positions.

Dynamically varying magnetic fields nearby or inside the combined striker volume are not compatible with the AAS sensing approach; these fields from devices such as lapel microphones, headsets, earphones, or vocal microphones will distort the AAS measurements in a way that is very difficult to compensate. Thus, when instrumented strikers include an AAS device, a close microphone on the percussionist's voice should be avoided. Rather, a distant, highly directional microphone is preferred.

Figure 19:
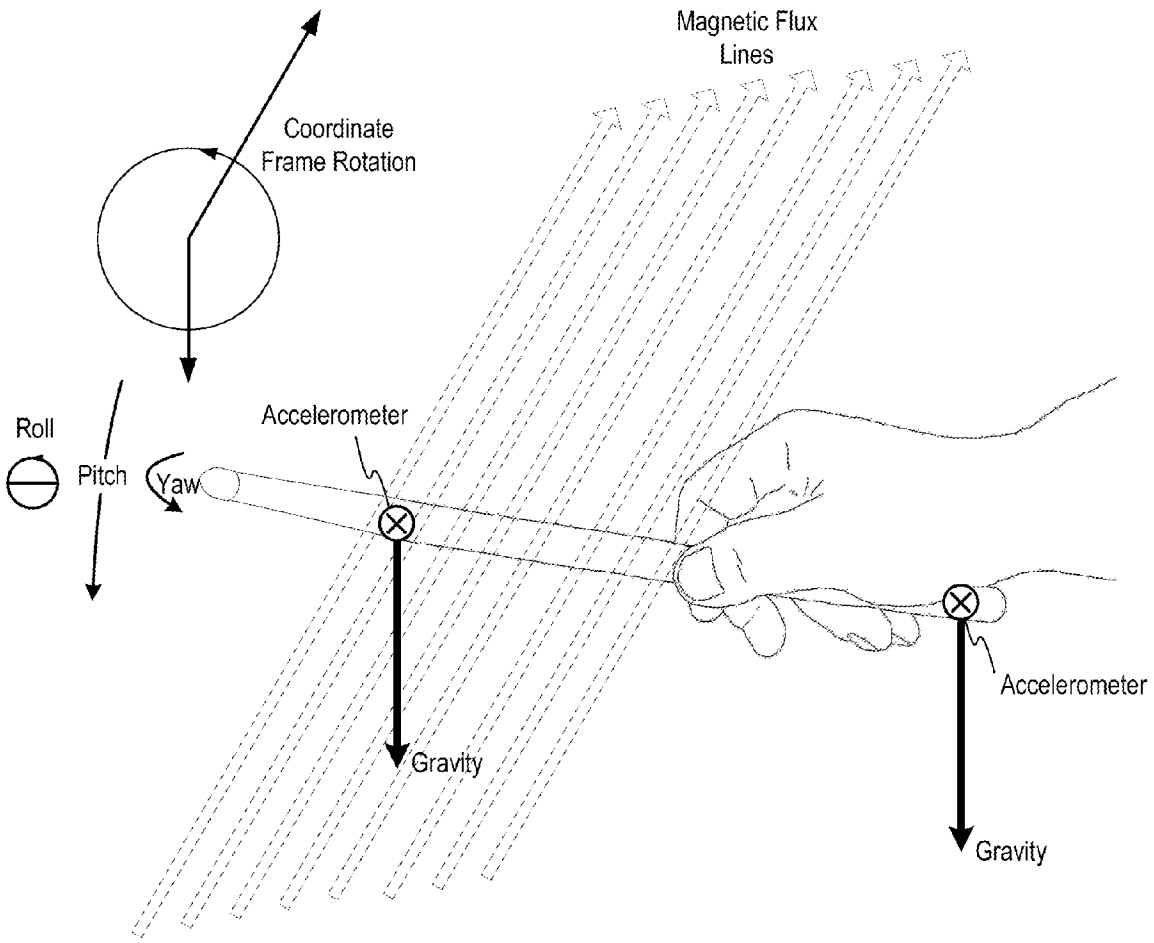
FIG. 19 depicts the relationship of the sensed magnetic flux to the sensed gravity field, and resolving pitch, roll and yaw of the instrumented striker.

Referring now to FIG. 19, this Figure depicts the transformation of the measured direction of the magnetic attitude to obtain the gravity attitude. The Magnetic Frame and Gravity Frame are each measured during initialization activities, either in instrumented striker 402 with its 3-axis AAS and accelerometers or with the striker when it is placed motionless along sensor-enabled striking surface 404. From the Magnetic Frame and the Gravity Frame, a constant coordinate frame direction cosine matrix "DCM" is computed for performing a coordinate transformation, as taught by Britting in section 2.1.3 on page 13.

In FIG. 19, the magnetic attitude is illustrated by a pair of arrows, one on the symmetric axis of the striker, and the other parallel to the magnetic flux lines. As depicted, the magnetic attitude is influenced by the pitch, roll and yaw of the instrumented striker, which is significant to accurately solving the gravity attitude of the striker. The magnetic attitude is used with the Magnetic to Gravity DCM to compute the Gravity Attitude of the instrumented striker, a 3-axis unit vector that points in the direction of gravity relative to the Striker Frame. The previously measured gravity magnitude is then multiplied upon the Gravity Attitude (a unit vector) to accurately compute the 3-axis gravity acceleration force relative to the Striker Frame. Finally, as taught by Britting, the gravity acceleration force is subtracted from the 3-axis accelerometer measurements.

Britting teaches sensor axis alignment and platform alignment error corrections in Chapter 8; alignments are applied to magnetic attitude and the accelerometer measurements. A DCM is computed for aligning the AAS sensor, and another DCM is computed for each of the 3-axis accelerometers during the striker initialization, when the performer first places the instrumented striker on the sensor-enabled striking surface motionless, and then rolls it on the surface. Following Brittings teachings, measurements taking by the sensors in the instrumented striker at known times and positions (sensed by the sensor-enabled surface on the Surface Frame) are then converted into the AAS alignment DCM and the alignment DCM for each accelerometer.

Figure 20:
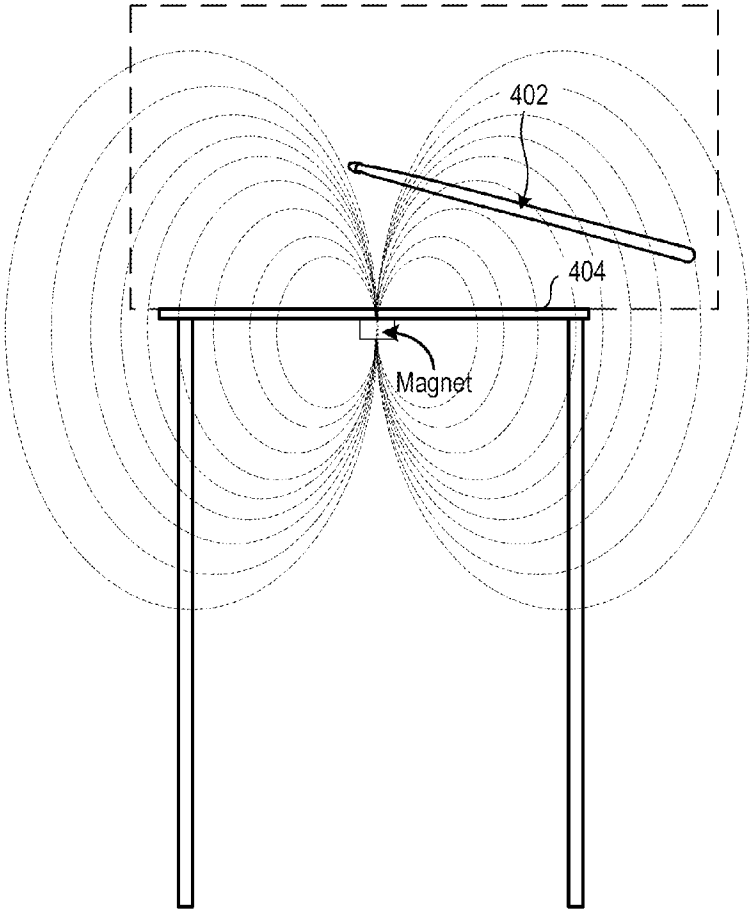
FIG. 20 depicts the optional addition of a permanent magnet to the sensor-enabled striking surface.

FIG. 20 depicts the installation of a permanent magnet beneath sensor-enabled striking surface 404. FIG. 20 depicts the magnet centered beneath the sensor-enabled striking surface producing magnetic field lines through the striker volume above sensor-enabled striking surface 404. The striker volume is shown as a dashed line to indicate the boundary for the right hand instrumented striker 402. The installation of a loudspeaker type of magnet (approximately 1 to 2 Tesla) provides approximately five orders of magnitude improved field strength over Earth's Magnetic Field. The magnetic field direction and strength is measured at the manufacturing facility (of percussion controller 400) and stored in processor-accessible storage 860. This data is used to correct the AAS measurements. In this way, the dynamically varying magnetic concerns from devices such as lapel microphones, headsets, earphones, or vocal microphones are eliminated by the strength of the fixed magnet under sensor-enabled striking surface 404.

It is to be understood that the disclosure teaches just one example of the illustrative embodiment and that many variations of the invention can easily be devised by those skilled in the art after reading this disclosure and that the scope of the present invention is to be determined by the following claims.

What is claimed:

1. A percussion controller comprising:

an instrumented striker; and a data processing system, wherein the data processing system:

a) generates a plurality of virtual impact zones, wherein each zone corresponds to a different musical event;

b) receives first signals that convey information pertaining to movement of the instrumented striker;

c) generates a location prediction and a force prediction based on information conveyed by the first signals, wherein:

(i) the location prediction predicts a location of intersection of the instrumented striker and one of the virtual impact zones, (ii) the force prediction predicts a force with which the instrumented striker would strike the location of intersection if the virtual impact zone were physically manifested;

d) relates the location of intersection to a musical event; and e) generates a musical event message based on the musical event.

2. The percussion controller of claim 1 and further wherein the location prediction is based, at least in part, on inertial navigation computations.

3. The percussion controller of claim 1 and further comprising a striking surface for striking with the instrumented striker, wherein the striking surface does not include any sensors.

4. The percussion controller of claim 3 and further wherein the data processing system maps at least some of the plurality of virtual impact zones to locations on the striking surface, thereby defining physical impact zones on the striking surface, wherein each physical impact zone corresponds to the musical event associated with virtual impact zone that defined the physical impact zone.

5. The percussion controller of claim 4 wherein the striking surface comprises a resilient surface.

6. The percussion controller of claim 5 and further wherein the striking surface comprises a plurality of lights, wherein the data processing system is operable to selectively illuminate some of the lights to demarcate the physical impact zones.

7. The percussion controller of claim 4 and further comprising an auxiliary instrumented mat that generates second signals, wherein the data processing system uses the second signals to perform at least one of the following tasks: (i) initialize inertial navigation computations, and (ii) provide on-going corrections to inertial navigation computations.

8. The percussion controller of claim 1 and further comprising a sensor-enabled striking surface including a resilient surface for striking with the instrumented striker and a plurality of sensors disposed beneath the sensor-enabled striking surface, wherein the data processing system:

(f) receives second signals that convey information pertaining to the movement of the instrumented striker toward the sensor-enabled striking surface;

(g) predicts, based on the information conveyed by the second signals, at least one of:

(i) a force of impact of the instrumented striker on the sensor-enabled striking surface, and (ii) a location at which the instrumented striker will impact the sensor-enabled striking surface;

(h) relates the location of impact to a musical event; and (i) generates a musical event message based on the musical event.

9. The percussion controller of claim 8 and further comprising an instrumented mat that controls one or more attributes of the sensor-enabled striking surface.

10. The percussion controller of claim 9 wherein striking the instrumented mat at a first location changes the musical event that corresponds to a first location on the sensor-enabled striking surface.

11. The percussion controller of claim 9 wherein striking the instrumented mat at a first location changes an instrument that the sensor-enabled striking surface simulates in conjunction with the data processing system.

12. The percussion controller of claim 10 wherein striking the instrumented mat a second location changes an instrument that the sensor-enabled striking surface simulates in conjunction with the data processing system.

13. The percussion controller of claim 9 wherein the sensor-enabled striking surface simulates a first instrument and the instrument mat simulates a second instrument.

14. The percussion controller of claim 8 and further comprising a foot switch, wherein the foot switch controls one or more attributes of the sensor-enabled striking surface.

15. The percussion controller of claim 1 and further wherein the data processing system alters a number of virtual impact zones in the plurality thereof.

16. The percussion controller of claim 15 and further wherein the data processing system increases the number of virtual impact zones, wherein additional virtual impact zones correspond to additional musical events.

17. The percussion controller of claim 1 and further wherein the data processing system changes the musical events that correspond to particular virtual impact zones.

18. The percussion controller of claim 1 wherein at least one of the virtual impact zones correspond to a cymbal.

19. The percussion controller of claim 1 and further wherein the data processing system:

(f) compares the movement of the instrumented striker, as conveyed by the information in the first signals, to predetermined striker motion patterns that correspond to musical events;

(g) characterizes the movement of the instrumented striker as a non-throwing motion when the striker's movement matches one of the predefined striker motion patterns; and (h) generates a second signal that conveys second information about the musical event corresponding to the matched predefined striker motion pattern.

20. The percussion controller of claim 1 and further wherein the data processing system stores information related to acceleration and position of the instrumented striker, wherein the information is indicative of a user's striker-throwing technique.

21. The percussion controller of claim 20 wherein the data processing system:

generates a visual representation of the user's striker-throwing technique from the information indicative thereof; and displays the visual representation for viewing.

22. The percussion controller of claim 20 and further wherein the data processing system assesses the user's striker-throwing technique.

23. The percussion controller of claim 22 wherein the data processing system assesses the user's striker-throwing technique by comparing the information indicative of the user's striker-throwing technique to reference information pertaining to throwing technique.

24. The percussion controller of claim 23 wherein the reference information comprises a prerecorded reference performance.

25. A method comprising:

predicting a location of intersection of an instrumented striker with a virtual impact zone based on signals received from the instrumented striker;

predicting, based on the signals received from the instrumented striker, a force with which the instrumented striker would strike the virtual impact zone if the virtual impact zone were physically manifested;

relating the location of intersection with a musical event;

generating a first signal that conveys first information about the musical event; and transmitting the first signal to a device that generates a second signal that can be converted to sound that is related to the musical event.

26. The method of claim 25 and further comprising mapping the virtual impact zone onto a striking surface.

27. The method of claim 25 and further comprising:

mapping predefined motion patterns to musical events;

comparing motion of the instrumented striker to the predefined motion patterns;

when the motion matches one of the predefined motion patterns, generating a third signal that conveys second information about the corresponding musical event; and transmitting the third signal to the device for generating signals that can be converted to a sound that is related to the corresponding musical event.

28. The method of claim 25 and further comprising storing information related to acceleration and position of the instrumented striker, wherein the information is indicative of a user's striker-throwing technique.

29. The method of claim 28 and further comprising assessing the user's striker-throwing technique.

30. The method of claim 29 wherein assessing the user's striker-throwing technique further comprises comparing the information indicative of the user's striker-throwing technique to reference information pertaining to throwing technique.

31. The method of claim 30 wherein the reference information comprises a prerecorded reference performance.

32. The method of claim 29 wherein assessing the user's throwing technique further comprises:

generating a visual representation of the user's technique from the information indicative thereof; and displaying the visual representation for viewing.

33. The method of claim 25 and further comprising:

generating, at the third device, the signals that can be converted to the sound that is related to the corresponding musical event; and generating the sound.

34. A method comprising:

monitoring motion of a striker;

predicting, using information obtained from the monitoring, at least one of a location or a force as follows:

(a) a location at which the striker will impact a striking surface, (b) a location at which the striker will intersect a virtual impact zone, (c) a force with which the striker will impact the striking surface at the location, or (d) a force with which the striker would impact the virtual impact zone at the location of intersection, if the virtual impact zone were physically manifested;

generating a visual representation of the monitored motion;

displaying the visual representation for viewing; and generating a musical event message from the at least one predicted location or force.

35. The method of claim 34 and further comprising assessing a throwing technique of a user that is using the striker.

36. The method of claim 35 and wherein the throwing technique being assessed is selected from the group consisting of a wrist pivot, whether grip is slipping, whether the striker is being rolled, whether a pre-impact release of throwing force occurs, single stroke throw about wrist axis and bounce, and double stroke throw and bounce.

37. The method of claim 35 and further wherein assessing the throwing technique comprises comparing the throwing technique to reference information pertaining to striker throwing technique.

38. The method of claim 35 wherein predicting at least one of a location or a force is based, at least in part, on inertial navigation computations and further wherein assessing the throwing technique is based on at least some of the intertial navigation computations.

39. A percussion controller comprising:

an instrumented striker;

a resilient striking surface for striking with the instrumented striker, wherein the striking surface does not include any sensors; and a data processing system, wherein the data processing system:

(a) receives first signals that convey information pertaining to kinetics of the instrumented striker; and (b) processes the first signals using inertial navigation techniques to predict at least one of:

(i) a future location of the instrumented striker;

(ii) a force with which the instrumented striker will impact a surface at the future location;

(iii) a force with which the instrumented striker would impact a virtual impact zone at the future location, if the virtual impact zone were physically manifested.

* * * * *